US012104237B2

(12) United States Patent
Rezaei Farkoosh et al.

(10) Patent No.: US 12,104,237 B2
(45) Date of Patent: Oct. 1, 2024

(54) ULTRA-STRONG ALUMINUM ALLOYS FOR AMBIENT AND HIGH-TEMPERATURE APPLICATIONS

(71) Applicant: NORTHWESTERN UNIVERSITY, Evanston, IL (US)

(72) Inventors: Amir Rezaei Farkoosh, Evanston, IL (US); David C. Dunand, Evanston, IL (US); David N. Seidman, Evanston, IL (US)

(73) Assignee: NORTHWESTERN UNIVERSITY, Evanston, IL (US)

( * ) Notice: Subject to any disclaimer, the term of this patent is extended or adjusted under 35 U.S.C. 154(b) by 27 days.

(21) Appl. No.: 17/670,883

(22) Filed: Feb. 14, 2022

(65) Prior Publication Data

US 2022/0267884 A1 Aug. 25, 2022

Related U.S. Application Data

(60) Provisional application No. 63/150,149, filed on Feb. 17, 2021.

(51) Int. Cl.
*C22F 1/04* (2006.01)
*B22D 7/00* (2006.01)
(Continued)

(52) U.S. Cl.
CPC ..... *C22F 1/04* (2013.01); *B22D 7/005* (2013.01); *C22C 1/026* (2013.01); *C22C 21/00* (2013.01)

(58) Field of Classification Search
CPC ..... C22F 1/04; B22D 7/005; B22D 21/04; C22C 1/026; C22C 21/00
See application file for complete search history.

(56) References Cited

U.S. PATENT DOCUMENTS

2003/0165397 A1* 9/2003 Auran ..... C22C 21/02 420/541
2017/0165795 A1 6/2017 Lenczowski
(Continued)

FOREIGN PATENT DOCUMENTS

CA 2941734 C 7/2017
CN 106573346 B 11/2019
(Continued)

OTHER PUBLICATIONS

F. Qian, S. Jin, G. Sha, Y. Li, Enhanced dispersoid precipitation and dispersion strengthening in an Al alloy by microalloying with Cd, Acta Mater. 157 (2018) 114-125.
(Continued)

*Primary Examiner* — Adil A. Siddiqui
(74) *Attorney, Agent, or Firm* — Locke Lord LLP; Tim Tingkang Xia, Esq.

(57) ABSTRACT

This invention discloses a series of low-cost, castable, weldable, brazeable and heat-treatable aluminum alloys based on modifications of aluminum-manganese-based alloys, which turn all the non-heat treatable Mn-containing aluminum alloys into heat treatable alloys with high-strength, ductility, thermal stability, and resistance to creep, coarsening and recrystallization. These alloys inherit the excellent corrosion resistance of the Al—Mn-based alloys and can be utilized in high temperature, high stress and a variety of other applications. The modifications are made through microalloying with one or any combinations of tin, indium, antimony and bismuth at an impurity level of less than 0.02 at. %, which creates nanoscale α-Al(Mn,TM)Si precipitates with a cubic structure (wherein TM is one or more of transition metals, and Mn is the main element) in an Al(f.c.c.)-matrix with a mean radius of about 25 nm and a relatively high volume fraction of about 2%.

9 Claims, 9 Drawing Sheets

(51) Int. Cl.
*C22C 1/02* (2006.01)
*C22C 21/00* (2006.01)

(56) References Cited

U.S. PATENT DOCUMENTS

2019/0390312 A1* 12/2019 Vo ..... C22C 21/08
2020/0149141 A1* 5/2020 Wu ..... C22F 1/04

FOREIGN PATENT DOCUMENTS

WO 2013130274 A2 9/2013
WO 2018009359 A1 1/2018

OTHER PUBLICATIONS

Y. Murakami, K. Mori, Highly supersaturated Al-Mn solid solution alloys and their decomposition by heat-treatment, Journal of Japan Institute of Light Metals 18(6) (1968) 339-346.
L.F. Mondolfo, Aluminum alloys : structure and properties, Butterworths, London, 1976.
K. Nagahama, I. Miki, Precipitation during Recrystallization in Al—Mn and Al—Cr Alloys, Transactions of the Japan Institute of Metals 15(3) (1974) 185-192.
N.J. Luiggi, Isothermal precipitation of commercial 3003 Al alloys studied by thermoelectric power, Metallurgical and Materials Transactions B 28(1) (1997) 125-133.
Lodgaard, N. Ryum, Precipitation of dispersoids containing Mn and/or Cr in Al—Mg—Si alloys, Materials Science and Engineering: A 283(1) (2000) 144-152.
R.A. Michi, J.P. Toinin, A.R. Farkoosh, D.N. Seidman, D.C. Dunand, Effects of Zn and Cr additions on precipitation and creep behavior of a dilute Al—Zr—Er—Si alloy, Acta Mater. 181 (2019) 249-261.
A.R. Farkoosh, D.C. Dunand, D.N. Seidman, Tungsten solubility in L12-ordered Al3Er and Al3Zr nanoprecipitates formed by aging in an aluminum matrix, J. Alloys Compd. 820 (2020) 153383.
A.R. Farkoosh, D.C. Dunand, D.N. Seidman, Effects of W and Si microadditions on microstructure and the strength of dilute precipitation-strengthened Al—Zr—Er alloys, Materials Science and Engineering: A 798 (2020) 140159.
K.E. Knipling, D.C. Dunand, D.N. Seidman, Criteria for developing castable, creep-resistant aluminum-based alloys—A review, Z. Metallk. 97(3) (2006) 246-265.
A. De Luca, D.C. Dunand, D.N. Seidman, Microstructure and mechanical properties of a precipitation-strengthened Al—Zr—Sc—Er—Si alloy with a very small Sc content, Acta Mater 144 (2018) 80-91.
Y.J. Li, L. Amberg, Quantitative study on the precipitation behavior of dispersoids in DC-cast AA3003 alloy during heating and homogenization, Acta Mater. 51(12) (2003) 3415-3428.
Y.J. Li, A.M.F. Muggerud, A. Olsen, T. Furu, Precipitation of partially coherent α-Al(Mn,Fe)Si dispersoids and their strengthening effect in AA 3003 alloy, Acta Mater. 60(3) (2012) 1004-1014.
A.R. Farkoosh, Development of creep-resistant Al—Si cast alloys strengthened with nanoscale dispersoids, McGill Unversity, 2014.
A.R. Farkoosh, X.G. Chen, M. Pekguleryuz, Dispersoid strengthening of a high temperature Al—Si—Cu—Mg alloy via Mo addition, Mater. Sci. Eng., A 620 (2015) 181-189.
A.R. Farkoosh, X.G. Chen, M. Pekguleryuz, Interaction between molybdenum and manganese to form effective dispersoids in an Al—Si—Cu—Mg alloy and their influence on creep resistance, Mater. Sci. Eng., A 627 (2015) 127-138.
M. Cooper, K. Robinson, The crystal structure of the ternary alloy a (AlMnSi), Acta Crystallogr. 20(5) (1966) 614-617.
A.M.F. Muggerud, Y. Li, R. Holmestad, S.J. Andersen, Mackay icosahedron explaining orientation relationship of dispersoids in aluminium alloys, Acta Crystallographica Section B 70(5) (2014) 888-896.
Y. Fan, M.M. Makhlouf, Stabilizing the strengthening precipitates in aluminum-manganese alloys by the addition of tungsten, Materials Science and Engineering: A 691 (2017) 1-7.
M. Vlach, I. Stuliková, B. Smola, H. Cisarová, J. Piešová, S. Daniš, R. Gemma, J. Malek, D. Tanprayoon, V. Neubert, Phase transformations in non-isothermally annealed as-cast and cold-rolled AlMnScZr alloys, International Journal of Materials Research 103(7) (2012) 814-820.
Z. Li, Z. Zhang, X.G. Chen, Effect of Metastable Mg2Si and Dislocations on α-Al(MnFe)Si Dispersoid Formation in Al—Mn—Mg 3xxx Alloys, Metallurgical and Materials Transactions A 49(11) (2018) 5799-5814.
H. Hirasawa, Precipitation process of Al—Mn and Al—Cr supersaturated solid solution in presence of age hardening phases, Scripta Metallurgica 9(9) (1975) 955-958.
T. Homma, M.P. Moody, D.W. Saxey, S.P. Ringer, Effect of Sn Addition in Preprecipitation Stage in Al—Cu Alloys: A Correlative Transmission Electron Microscopy and Atom Probe Tomography Study, Metallurgical and Materials Transactions A 43(7) (2012) 2192-2202.
B.W. Krakauer, D.N. Seidman, Systematic procedures for atom-probe field-ion microscopy studies of grain boundary segregation, Rev. Sci. Instrum. 63(9) (1992) 4071-4079.
D.N. Seidman, Three-Dimensional Atom-Probe Tomography: Advances and Applications, Annual Review of Materials Research 37(1) (2007) 127-158.
D.N. Seidman, B.W. Krakauer, D. Udler, Atomic scale studies of solute-atom segregation at grain boundaries: Experiments and simulations, J. Phys. Chem. Solids 55(10) (1994) 1035-1057.
D.N. Seidman, Subnanoscale Studies of Segregation at Grain Boundaries: Simulations and Experiments, Annual Review of Materials Research 32(1) (2002) 235-269.
D.N. Seidman, K. Stiller, An Atom-Probe Tomography Primer, MRS Bull. 34(10) (2009) 717-724.
B. Gault, M.P. Moody, F.d. Geuser, G. Tsafnat, A.L. Fontaine, L.T. Stephenson, D. Haley, S.P. Ringer, Advances in the calibration of atom probe tomographic reconstruction, J. Appl. Phys. 105(3) (2009) 034913.
B. Gault, M.P. Moody, J.M. Cairney, S.P. Ringer, Atom probe microscopy, Springer-Verlag New York 2012.
O.C. Hellman, J.A. Vandenbroucke, J. Rüsing, D. Isheim, D.N. Seidman, Analysis of three-dimensional atom-probe data by the proximity histogram, Microsc. Microanal. 6(5) (2000) 437-444.
C.K. Sudbrack, R.D. Noebe, D.N. Seidman, Direct observations of nucleation in a nondilute multicomponent alloy, Physical Review B 73(21) (2006) 212101.
T. Takeuchi, T. Onogi, E. Banno, U. Mizutani, Direct Evidence of the Hume-Rothery Stabilization Mechanism in Al—Mn—Fe—Si Mackay-Type 1/1-Cubic Approximants, Materials Transactions 42(6) (2001) 933-938.
K. Sugiyama, N. Kaji, K. Hiraga, Re-Refinement of [alpha]-(AlMnSi), Acta Crystallographica Section C 54(4) (1998) 445-447.
H.J. Frost, M.F. Ashby, Deformation mechanism maps: the plasticity and creep of metals and ceramics, Pergamon press 1982.
M.E. Kassner, Fundamentals of Creep in Metals and Alloys (Third Edition), Butterworth-Heinemann, Boston, 2015.
F.R.N. Nabarro, F. De Villiers, Physics of creep and creep-resistant alloys, CRC press 1995.
M.E. Krug, D.N. Seidman, D.C. Dunand, Creep properties and precipitate evolution in Al—Li alloys microalloyed with Sc and Yb, Mater. Sci. Eng. A 550 (2012) 300-311.
N.Q. Vo, D. Bayansan, A. Sanaty-Zadeh, E. Ramos, D.C. Dunand, Effect of Yb microadditions on creep resistance of a dilute Al—Er—Sc—Zr alloy, Materialia (2018).
Y.-H. Yeh, H. Nakashima, H. Kurishita, S. Goto, H. Yoshinaga, High-Temperature Creep and Threshold Stress of Precipitation-Hardened Al-0.7 at%Mn Alloy, Mater. Trans., JIM 32(1) (1991) 52-60.
E. Arzt, M.F. Ashby, Threshold stresses in materials containing dispersed particles, (1982).
E. Arzt, D.S. Wilkinson, Threshold stresses for dislocation climb over hard particles: The effect of an attractive Interaction, Acta Metall. 34(10) (1986) 1893-1898.

(56) References Cited

OTHER PUBLICATIONS

Y. Li, T.G. Langdon, Creep behavior of an Al-6061 metal matrix composite reinforced with alumina particulates, Acta Mater. 45(11) (1997) 4797-4806.
R.A. Karnesky, PHD Thesis, Northwestern University, Mechanical properties and microstructure of aluminum-scandium with rare-earth element or aluminum oxide additions, 2007.
A.J. McAlister, D.J. Kahan, The Al—Sn (Aluminum-Tin) System, Bulletin of Alloy Phase Diagrams 4(4) (1983) 410-414.
T. Cheng, Y. Tang, L. Zhang, Update of thermodynamic descriptions of the binary Al—Sn and ternary Mg—Al—Sn systems, Calphad 64 (2019) 354-363.
G. ErdÉlyi, K. Freitag, H. Mehrer, Diffusion of tin implanted in aluminium, Philos. Mag. A 63(6) (1991) 1167-1174.
Q.S. Mei, K. Lu, Melting and superheating of crystalline solids: From bulk to nanocrystals, Prog. Mater Sci. 52(8) (2007) 1175-1262.
L.E. Samuels, The solid solubility of tin, indium and cadmium in aluminum J. Inst. Metals (1956) pp. 333-336.
R.C. Dorward, The solubility of tin in aluminum, Metall. Trans. A 7(2) (1976) 308-310.

* cited by examiner

20 X 20 X 20 nm3
b
c

{001}Al

{001}Al
2 at.% Sn
4 at.% Mn + Si
Sn
Mn
Si

ULTRA-STRONG ALUMINUM ALLOYS FOR AMBIENT AND HIGH-TEMPERATURE APPLICATIONS

CROSS-REFERENCE TO RELATED PATENT APPLICATION

This application claims priority to and the benefit of U.S. Provisional Application No. 63/150,149, filed Feb. 17, 2021, which is incorporated herein in its entirety by reference.

STATEMENT AS TO RIGHTS UNDER FEDERALLY-SPONSORED RESEARCH

This invention was made with government support under N00014-18-1-2550 awarded by the Office of Naval Research. The government has certain rights in the invention.

FIELD OF THE INVENTION

The present invention relates generally to the material science and engineering, and more particularly to the synthesis of ultra-strong aluminum alloys for ambient and high-temperature applications.

BACKGROUND OF THE INVENTION

The background description provided herein is for the purpose of generally presenting the context of the invention. The subject matter discussed in the background of the invention section should not be assumed to be prior art merely as a result of its mention in the background of the invention section. Similarly, a problem mentioned in the background of the invention section or associated with the subject matter of the background of the invention section should not be assumed to have been previously recognized in the prior art. The subject matter in the background of the invention section merely represents different approaches, which in and of themselves may also be inventions. Work of the presently named inventors, to the extent it is described in the background of the invention section, as well as aspects of the description that may not otherwise qualify as prior art at the time of filing, are neither expressly nor impliedly admitted as prior art against the invention.

Various aluminum alloys have been developed for ambient and high-temperature applications by increasing the coarsening resistance of the age-hardening precipitates or creating new thermally stable precipitates in aluminum. The best existing high-temperature commercial aluminum alloys become very weak at temperatures exceeding about 300° C., due to the coarsening or dissolution of their strengthening precipitates. Over the last two decades, new aluminum alloys (Scalmalloy© from Airbus and NanoAl from Braidy Industries—now Unity Aluminum) have become available that utilize slow-diffusing alloying additions, such as scandium and zirconium, which upon aging form thermally stable $Al_3(Sc_{1-x}Zr_x)$ nanoprecipitates with an L12-structure. Their utilization is, however, limited to low stress applications at 300-400° C. due to the limited strength and creep resistance imparted by the small volume fractions of the $L1_2$-nanoprecipitates. Additionally, they have a high production cost due to the use of Zr, and especially Sc.

Therefore, a heretofore unaddressed need exists in the art to address the aforementioned deficiencies and inadequacies.

SUMMARY OF THE INVENTION

One of the objectives of this invention is to disclose a series of low-cost, castable, weldable, brazeable and heat-treatable aluminum alloys developed based on the modifications made to aluminum-manganese-based (for example, commercial 3000 series) alloys, which turn all these non-heat treatable (that is, with negligible precipitation strengthening) Mn-containing aluminum alloys into heat treatable (that is, precipitation strengthened) alloys with high-strength, ductility, thermal stability, creep, coarsening and recrystallization resistance. These alloys can be utilized at high temperatures under high stresses for a variety of light-weight applications.

Unlike the conventional aluminum alloys developed for high-temperature applications by increasing the coarsening resistance of the age-hardening precipitates or creating new thermally stable precipitates in aluminum, the invention in some embodiments takes the advantage of the heterogeneous nucleation phenomenon and creates a high-volume fraction of thermally-stable nanoscale precipitates, which impart significant strengthening at high- and ambient-temperatures.

In one aspect, the invention relates to an aluminum alloy comprising aluminum (Al), manganese (Mn), silicon (Si), and one or any combinations of elements tin (Sn), indium (In), antimony (Sb) and bismuth (Bi).

In one embodiment, said manganese comprises 0.3-0.7 at. % of said aluminum alloy; said silicon comprises about 0.2-1.0 at. % of said aluminum alloy; and said tin or indium or antimony or bismuth or any combinations of tin, indium, antimony and bismuth comprises preferably about 0.01-0.02 at. % of said aluminum alloy.

In one embodiment, the aluminum alloy further comprises an impurity-level concentration of iron (Fe) that is at most about 0.3 at. % of said aluminum alloy.

In one embodiment, the aluminum alloy further comprises at least one of gallium (Ga), copper (Cu), titanium (Ti), vanadium (V), chromium (Cr), zirconium (Zr) and zinc (Zn).

In one embodiment, said iron comprises at most about 0.3 at. % of said aluminum alloy; said gallium comprises at most about 0.01 at. % of said aluminum alloy; said copper comprises at most about 0.01-0.1 at. % of said aluminum alloy; said titanium comprises at most about 0.01-0.11 at. % of said aluminum alloy; said vanadium comprises at most about 0.01-0.05 at. % of said aluminum alloy; said zirconium comprises about 0.01-0.1 at. % of said aluminum alloy; said chromium comprises at most 0.01-0.10 at. % of said aluminum alloy and said zin comprises about 0.01-0.3 at. % of said aluminum alloy.

In one embodiment, the aluminum alloy is characterized with a peak microhardness value of about 525±5 MPa upon isochronal aging to about 475° C. This value can be further increased by adjusting the Si and Zr concentrations. For example, another variant of the Sn-modified alloy with about 0.6 at. % Si has a peak microhardness value of about 650 MPa. Or another variant of our Sn-modified alloy with 0.09 at. % Zr and 0.3Si has a microhardness value of about 725 MPa. It is anticipated to achieve a peak microhardness value of up to 1000-1200 MPa in this alloy system.

In one embodiment, the refinement of the α-precipitate distribution is related mainly to the formation of the Al—X, (X=Sn, In, Sb, Bi) nanoprecipitates at intermediate temperatures, which help heterogeneous nucleation of α-precipitates.

In one embodiment, the α-Al(Mn,Fe)Si precipitates are distributed uniformly.

In one embodiment, the number densities of the α-Al(Mn, Fe)Si precipitates at the peak-aged state are greater than about $10^{22}$ $m^{-3}$.

In one embodiment, the mean radii of the α-Al(Mn,Fe)Si precipitates at the peak-aged state are less than about 25 nm.

In one embodiment, the aluminum alloy comprises tin-rich nanoprecipitates with a mean radius of about 1.5 nm within the Al(f.c.c.) matrix.

In another aspect, the invention relates to a method for producing an aluminum alloy comprising: providing a first molten mass of aluminum held at a first temperature of about 650 to 900° C.; adding tin, antimony, indium, bismuth (alone or in combination) and a series of master alloys sequentially to the first molten mass with a holding time of about 10-20 min between each addition to produce a second molten mass, wherein the series of master alloys comprises Al-10Mn and Al-12Si (at. %), and wherein the Al-10Mn master alloy was preheated at a second temperature of about 500-600° C.; and after Si additions, maintaining the second molten mass at the first temperature for about 0.5-1.5 h, periodically stirring and then casting the second molten mass into a mold to form an ingot, wherein the mold is preheated at a third temperature of about 100-300° C., and placed on an ice-cooled copper platen immediately prior to casting, to enhance directional solidification.

In one embodiment, the method further comprises isochronally aging the ingot in air, and water quenching the aged ingot.

In one embodiment, said isochronally aging the ingot in air is performed with about 25° C. steps lasting about 1 h, from about 150° C. to about 575° C.

In one embodiment, no homogenization is performed prior to aging to avoid the decomposition of the as-cast supersaturated Al—Mn solid solution.

In one aspect, the invention relates to an aluminum alloy comprising aluminum (Al), manganese (Mn), silicon (Si), and one or any combinations of the elements tin (Sn), indium (In), antimony (Sb) and bismuth (Bi).

In one embodiment, said manganese comprises about 0.3-0.7 at. % of said aluminum alloy; said silicon comprises about 0.2-1.0 at. % of said aluminum alloy; and said tin or indium or antimony or bismuth or any combinations of tin, indium, antimony and bismuth comprises preferably about 0.01-0.02 at. % of said aluminum alloy.

In one embodiment, the aluminum alloy further comprises an impurity-level concentration of iron (Fe) that is at most about 0.3 at. % of said aluminum alloy.

In one embodiment, the aluminum alloy further comprises at least one of gallium (Ga), copper (Cu), titanium (Ti), vanadium (V), chromium (Cr), zirconium (Zr) and zinc (Zn).

In one embodiment, said iron comprises at most about 0.3 at. % of said aluminum alloy; said gallium comprises at most about 0.01 at. % of said aluminum alloy; said copper comprises at most about 0.01-0.1 at. % of said aluminum alloy; said titanium comprises at most about 0.01-0.11 at. % of said aluminum alloy; said vanadium comprises at most about 0.01-0.05 at. % of said aluminum alloy; said zirconium comprises about 0.01-0.1 at. % of said aluminum alloy; said chromium comprises at most 0.01-0.10 at. % of said aluminum alloy and said zin comprises about 0.01-0.3 at. % of said aluminum alloy.

In yet another aspect, the invention relates to a method for producing an aluminum alloy, comprising forming a molten mass of aluminum comprising additions of manganese (Mn), silicon (Si) and tin (Sn) or indium (In) or antimony (Sb) or bismuth (Bi) or any combinations of tin (Sn) and indium (In) and antimony (Sb) and bismuth (Bi); and casting the molten mass to form an ingot.

In one embodiment, said forming the molten mass comprises: providing a first molten mass of aluminum held at a first temperature of about 650-900° C.; and adding tin, antimony, indium, bismuth (alone or in combination) and a series of master alloys sequentially to the first molten mass with a holding time of about 10-20 min between each addition to produce a second molten mass, wherein the series of master alloys comprises Al-10Mn and Al-12Si (at. %), and wherein the Al-10Mn master alloy was preheated at a second temperature of about 500-600° C.

In one embodiment, said casting the molten mass to form the ingot comprises maintaining the second molten mass at the first temperature for about 0.5-1.5 h, periodically stirring and then casting the second molten mass into a mold to form an ingot, wherein the mold is preheated at a third temperature of about 100-300° C., and placed on an ice-cooled copper platen immediately prior to casting, to enhance directional solidification.

In one embodiment, the method further comprises isochronally aging the ingot in air, and water quenching the aged ingot.

In one embodiment, no homogenization step is performed prior to aging to avoid the decomposition of the as-cast supersaturated Al—Mn solid solution.

In one aspect of the invention, the method for producing a heat-treatable alloy with high-strength, heat- and creep-resistance includes providing an aluminum-manganese-based alloy; and microalloying the aluminum-manganese-based alloy with additions of one or more of tin (Sn), indium (In), antimony (Sb) and bismuth (Bi), at an impurity level of less than 0.02 at. % (<0.1 wt. %), to form the alloy.

In one embodiment, the aluminum-manganese-based alloy comprises an Al-0.5Mn-0.3Si (at. %) alloy.

In one embodiment, the method further comprises continuous or isochronal heating the as-cast alloy to an aging temperature to create a high number density of the nanoscale α-precipitates with an excellent strengthening efficiency.

In one embodiment, the microalloying step creates nanoscale α-Al(Mn,TM)Si precipitates with a cubic structure in an Al(f.c.c.)-matrix with an average radius of about 25 nm or less and a relatively high volume fraction of about 1-2%, so as to improve the strength and creep resistance significantly by providing an additional population of thermally stable α-precipitates, wherein TM is one or more transition metals.

In one embodiment, the thermally stable α-precipitates comprise $L1_2$-structured nanoprecipitates.

In one embodiment, no solution treatments at high temperatures are performed.

These and other aspects of the present invention will become apparent from the following description of the preferred embodiment taken in conjunction with the following drawings, although variations and modifications therein may be affected without departing from the spirit and scope of the novel concepts of the invention.

BRIEF DESCRIPTION OF THE DRAWINGS

The accompanying drawings illustrate one or more embodiments of the invention and together with the written description, serve to explain the principles of the invention. Wherever possible, the same reference numbers are used throughout for the drawings to refer to the same or like elements of an embodiment.

FIG. 7A: 3-D APT reconstruction of a part of a Mn—Si-rich nanoprecipitate and a partial Sn-rich nanoprecipitate. The Al atoms are removed completely for the sake of clarity. The Mn—Si-rich and Sn-rich nanoprecipitates are delineated with the 4 at. % Mn plus Si and 2 at. % Sn isoconcentration surfaces, respectively. FIGS. 7B-7C: distribution of Sn, Mn and Si within the nanoprecipitates viewed along two different directions shown in FIG. 7A. Note that the Sn-rich nanoprecipitates formed below 200° C. (FIG. 5A) survived at 300° C.

DETAILED DESCRIPTION OF THE INVENTION

Figures 1A, 1B:
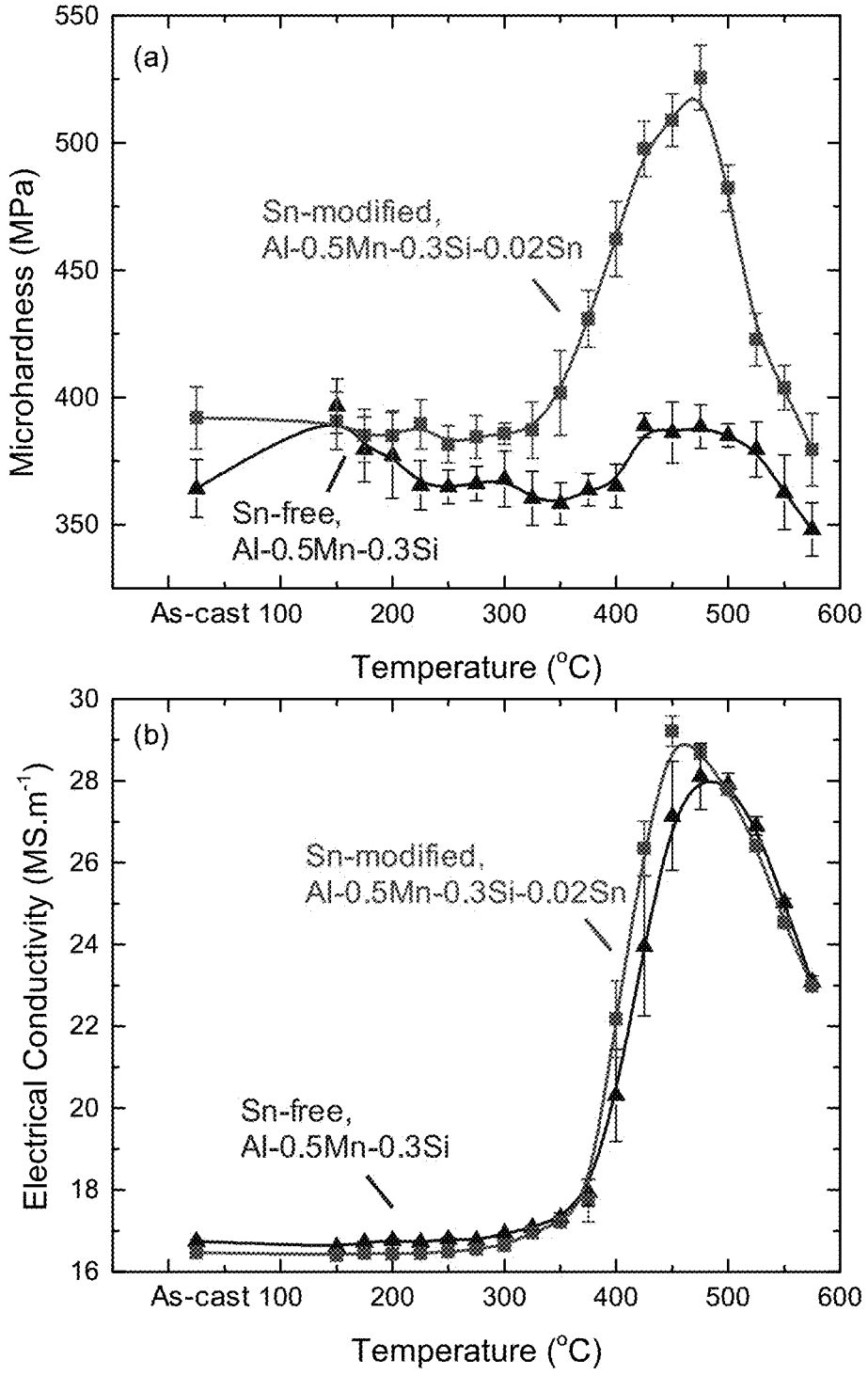
FIG. 1A shows microhardness for the Sn-modified Al-0.5Mn-0.3Si-0.02Sn and Sn-free Al-0.5Mn-0.3Si alloys, according to embodiments of the invention.
FIG. 1B shows electrical conductivity evolutions as a function of temperature during isochronal aging (1 h–25° C. steps) for the Sn-modified Al-0.5Mn-0.3Si-0.02Sn and Sn-free Al-0.5Mn-0.3Si alloys, according to embodiments of the invention.

The invention will now be described more fully hereinafter with reference to the accompanying drawings, in which exemplary embodiments of the invention are displayed. This invention may, however, be embodied in many different forms and should not be construed as limited to the embodiments set forth herein. Rather, these embodiments are provided so that this specification will be thorough and complete, and will convey fully the scope of the invention to those skilled in the art. Like reference numerals refer to like elements throughout.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting has no influence on the scope and meaning of a term; the scope and meaning of a term are the same, in the same context, whether or not it is highlighted. It will be appreciated that the same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the invention or of any exemplified term. Likewise, the invention is not limited to various embodiments given in this specification.

It will be understood that, as used in the description herein and throughout the claims that follow, the meaning of "a", "an", and "the" includes plural references unless the context clearly dictates otherwise. Also, it will be understood that when an element is referred to as being "on" another element, it can be directly on the other element or intervening elements may be present there between. In contrast, when an element is referred to as being "directly on" another element, there are no intervening elements present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the invention.

Furthermore, relative terms, such as "lower" or "bottom" and "upper" or "top," may be used herein to describe one element's relationship to another element as illustrated in the figures. It will be understood that relative terms are intended to encompass different orientations of the device in addition to the orientation depicted in the figures. For example, if the device in one of the figures. is turned over, elements described as being on the "lower" side of other elements would then be oriented on "upper" sides of the other elements. The exemplary term "lower" can, therefore, encompass both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

It will be further understood that the terms "comprises" and/or "comprising," or "includes" and/or "including" or "has" and/or "having", or "carry" and/or "carrying," or "contain" and/or "containing," or "involve" and/or "involving, and the like are to be open-ended, i.e., to mean including but not limited to. When used in this specification, they specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and this specification, and will not be interpreted in an idealized or overly formal sense unless expressly so defined herein.

As used in this specification, "around", "about", "approximately" or "substantially" shall generally mean within 20 percent, preferably within 10 percent, and more preferably within 5 percent of a given value or range. Numerical quantities given herein are approximate, meaning that the term "around," "about," "approximately" or "substantially" can be inferred if not expressly stated.

As used in this specification, the phrase "at least one of A, B, and C" should be construed to mean a logical (A or B or C), using a non-exclusive logical OR. As used herein, the term "and/or" includes any and all combinations of one or more of the associated listed items.

The description below is merely illustrative in nature and is in no way intended to limit the invention, its application, or uses. The broad teachings of the invention can be implemented in a variety of forms. Therefore, while this invention includes particular examples, the true scope of the invention should not be so limited since other modifications will become apparent upon a study of the drawings, the specification, and the following claims. For purposes of clarity, the same reference numbers will be used in the drawings to identify similar elements. It should be understood that one or more steps within a method may be executed in a different order (or concurrently) without altering the principles of the invention.

It is well established that Al—Mn based alloys exhibit poor age-hardening responses due mainly to the low ($<10^{19}$ $m^{-3}$) number density of their Mn-containing precipitates originating from a high (1.3-1.8 eV) activation energy for nucleation. Even in highly supersaturated, rapidly-solidified alloys, the hardening increments are much smaller than those of the common age-hardenable aluminum alloys, such as Al—Cu, Al—Mg—Si, Al—Cu—Mg—Si, Al—Zn—Mg—Cu or $L1_2$ strengthened Al—Sc—Zr. It may, nonetheless, be possible to create a fine dispersion of the Mn-containing precipitates in this alloy system through a controlled decomposition of the solid-solution to achieve a marked precipitation hardening, given the relatively large volume fractions of the Mn-containing precipitates ($V_f$~2%) attainable upon aging.

The most common Mn-containing precipitate formed in the commercial alloys is the α-Al(Mn,Fe)Si phase, which has a body-centered cubic (b.c.c.) or simple cubic (s.c.) structure, depending on its chemical composition (i.e., the Mn:Fe ratio and the presence of trace elements, such as boron), with a large lattice parameter, $a_0$, in the range 12-13 Å, corresponding to a cubic approximant phase. A one-dimensional (1-D) coherency between the (23-5) planes of the α-Al(Mn,Fe)Si precipitates and the {020} planes of the Al(f.c.c.) matrix has been reported, and the most commonly observed orientation relationship is $<1\text{-}11>_{\alpha}//<1\text{-}11>_{Al}$ and $\{5\text{-}2\text{-}7\}_{\alpha}//\{011\}_{Al}$. Precipitation of the α-Al(Mn,Fe)Si phase relies on the presence of Si (>0.1 at. %), which is a common impurity in commercial aluminum alloys. Highly nonuniform distributions of the α-Al(Mn,Fe)Si precipitates in the Al(f.c.c.) matrix have been reported by several investigators, which is most probably related to Si micro-segregation in the as-solidified alloys. Micro-additions of specific transition metals, such as Mo, Cr, V and W are known to improve the thermal stability of the α-precipitates, but with little impact on their sizes and distributions.

Different strategies are employed to inoculate the α-Al(Mn,Fe)Si precipitates, which are mainly based on a heterogeneous nucleation mechanism. Utilizing transmission electron microscopy (TEM) analyses, several sites for heterogeneous nucleation have been identified, such as dislocations in an AA3003 alloy and $Mg_2Si$ precipitates (or their precursors) in Al—Mg—Si alloys containing Mn and Cr. To date, the most dramatic improvements in the dispersion hardening effect of the α-Al(Mn,Fe)Si precipitates have been achieved through cadmium (Cd) micro-additions. A 25% increase in the yield strength of an AA3003 alloy by about 0.05 at. % Cd additions was reported, which has been related to the formation of Mn- and Si-rich clusters around the Al—Cd nanoprecipitates, assisting heterogeneous nucleation of the α-Al(Mn,Fe)Si precipitates. Cadmium is, however, a highly neurotoxic element.

In view of the aforementioned deficiencies and inadequacies, the invention in certain aspects discloses aluminum alloys that utilize Sn, In, Sb or Bi (Sn and In are non-toxic and Sb and Bi are far less toxic than trace elements, such as Cd) microalloying additions to enhance dramatically the age-hardening response of the Al—Mn system, thereby turning all the non-heat-treatable Mn-containing aluminum alloys (3000 and 4000 series) into heat-treatable alloys with high-strength, heat- and creep-resistance.

In some embodiments, a series of low-cost, castable, weldable, brazeable and heat-treatable aluminum alloys has been developed, based on modifications to aluminum-manganese-based (for example, commercial 3000 series) alloys, which turn all the non-heat treatable Mn-containing aluminum alloys, such as the 3000-series into heat treatable alloys with high-strength, ductility, thermal stability, and resistance to coarsening, creep, and recrystallization. These alloys inherit the excellent corrosion resistance of the Al—Mn-based alloys and can be utilized in high temperature, high stress, and a variety of other applications.

The modifications are made through microalloying with one or any combinations of elements tin (Sn), indium (In), antimony (Sb) and bismuth (Bi), at an impurity level of less than 0.02 at. % (<0.1 wt. %), which creates nanoscale α-Al(Mn,TM)Si precipitates with a cubic structure (wherein TM is one or more transition metals, and Mn is the main element) in an Al(f.c.c.)-matrix with an average radius of about 2.5 nm, and a relatively high volume fraction of about 1-2%. No solution treatments at high temperatures are required. A simple continuous (or isochronal) heating of the as-cast alloy to the aging temperature is sufficient to create a high number density (about $10^{22}$ $m^{-3}$) of the nanoscale α-precipitates with an excellent strengthening efficiency. The alloys are formulated to have a high tolerance for impurities, such as Fe and Si. Thus, secondary recycled Al—Mn-based alloys (with substantial Fe and Si impurity contents) can also be transformed into heat treatable alloys with the above mentioned mechanical properties by adjusting the Mn concentrations to accommodate the impurities. In case of wrought alloys, where the α-precipitates are utilized conventionally as recrystallization inhibitors, the modifications lead to a much higher recrystallization temperature and an excellent formability and workability. The modified alloys can retain the deformed structure to a higher degree after hot deformation at a given temperature and thus significantly better mechanical properties are achieved. In case of the other heat-treatable aluminum alloys, which are aged-hardened with GP-zones or other thermally-unstable precipitates, the modified α-precipitates can improve the strength and creep resistance significantly by providing an additional population of thermally stable α-precipitates. These modified α-precipitates can be combined with the other thermally stable precipitates, such as $L1_2$-structured nanoprecipitates, to create ultrahigh strength aluminum alloys for ambient and high-temperature applications.

According to embodiments of the invention, the addition of Sn, Sb, In or Bi is small and thus inexpensive, and importantly, it is below the impurity levels, which are tolerated in the specification of current Al—Mn alloys. Thus, the modification of an existing alloy family (Al—Mn-based) does not necessitate recertification of these alloys but can be implemented at a minimal cost (a few pennies per pound of aluminum for Sn, Sb, In or Bi), utilizing traditional heat-treatments, while boosting the strength of these alloys at high temperatures. They can displace steel and titanium alloys at a lower overall weight, or they can displace other aluminum alloys allowing for higher temperatures and/or higher stresses.

In one embodiment of the invention, the aluminum alloy comprises aluminum (Al), manganese (Mn), silicon (Si), and tin (Sn) or indium (In) or antimony (Sb) or bismuth (Bi) or any combinations of tin (Sn) and indium (In) and antimony (Sb) and bismuth (Bi). In addition to Sn, In, Sb, Bi and any combinations of these elements are also included as the inoculant. It is observed experimentally that these elements also work as inoculants for the precipitation of the α-precipitates through a similar heterogeneous nucleation mechanism as observed in the Sn-modified alloys.

In one embodiment, said manganese comprises about 0.3-0.7 at. % of said aluminum alloy; said silicon comprises about 0.2-1.0 at. % of said aluminum alloy; and said tin or indium or antimony or bismuth or any combinations of tin and indium and antimony and bismuth comprises preferably about 0.01-0.02 at. % of said aluminum alloy.

In one embodiment, the aluminum alloy further comprises an impurity-level concentration of iron (Fe), which is at most about 0.3 at. % of said aluminum alloy.

In one embodiment, the aluminum alloy further comprises at least one of gallium (Ga), copper (Cu), titanium (Ti), vanadium (V), chromium (Cr), zirconium (Zr) and zinc (Zn).

In one embodiment, said iron comprises at most about 0.3 at. % of said aluminum alloy; said gallium comprises at most about 0.01 at. % of said aluminum alloy; said copper comprises about 0.01-0.1 at. % of said aluminum alloy; said titanium comprises at most about 0.01-0.11 at. % of said aluminum alloy; said vanadium comprises at most about 0.01-0.05 at. % of said aluminum alloy; said chromium comprises at most about 0.1 at. % of said aluminum alloy; said zirconium comprises at most about 0.01-0.1 at. % of said aluminum alloy; and said zin comprises about 0.01-0.3 at. % of said aluminum alloy.

In one embodiment, the aluminum alloy is characterized with a peak microhardness value of about 525±5 MPa at about 475° C. This value can be increased by adjusting the Si and Zr concentrations. For example another variant of the Sn-modified alloy with about 0.6 at. % Si has a peak microhardness value of about 650 MPa. Or another variant of our Sn-modified alloy with 0.09 at. % Zr and 0.3Si has a microhardness value of about 725 MPa. It is anticipated to achieve a peak microhardness value of up to 1000-1200 MPa in this alloy system.

In one embodiment, the refinement of the α-precipitate distribution is related mainly to the formation of the Al—X, (X=Sn, In, Sb, Bi) nanoprecipitates at intermediate temperatures, which help heterogeneous nucleation of α-precipitates.

In one embodiment, the α-Al(Mn,Fe)Si precipitates are distributed uniformly.

In one embodiment, the number densities of the α-Al(Mn, Fe)Si precipitates at the peak-aged state are greater than about $10^{22}$ $m^{-3}$.

The aluminum alloy of claim 1, wherein the mean radii of the α-Al(Mn,Fe)Si precipitates at the peak-aged state are less than about 25 nm.

In one embodiment, the aluminum alloy comprises Al—X, (X=Sn, In, Sb, Bi) nanoprecipitates with a mean radius of about 1.5 nm within the Al(f.c.c.) matrix.

According to embodiments of the invention, the alloys exhibit much higher strength and creep resistance at high temperatures when compared to the commercially available aluminum alloys. The alloys can be exposed to high temperatures and retain their strength at low temperatures (enhanced brazeability and recrystallization resistance). Additionally, the alloys are compatible with the Al—Si brazing materials. Unlike many other aluminum alloys, silicon diffusion from the brazing material into the microstructure of the alloys does not alter the microstructure and mechanical properties significantly. The disclosed alloys with improved brazeability can be utilized in manufacturing heat exchangers with much thinner and stronger fins, tubes and other components, which can operate at higher temperatures and thus enhanced efficiency. The production cost of the disclosed alloys is also significantly lower than the recently developed high-temperature aluminum alloys.

In another aspect of the invention, the method for producing an aluminum alloy comprises providing a first molten mass of aluminum held at a first temperature of about 700-900° C.; adding tin, antimony, indium, bismuth (alone or in combination) and a series of master alloys sequentially to the first molten mass with a holding time of about 10-20 min between each addition to produce a second molten mass, wherein the series of master alloys comprises Al-10Mn and Al-12Si (at. %), and wherein the Al-10Mn master alloy was preheated at a second temperature of about 500-700° C.; and after Si additions, maintaining the second molten mass at the first temperature for about 0.5-1.5 h, periodically stirring and then casting the second molten mass into a mold to form an ingot, wherein the mold is preheated at a third temperature of about 100-300° C., and placed on an ice-cooled copper platen immediately prior to casting, to enhance directional solidification.

In one embodiment, the method further comprises isochronally aging the ingot in air, and water quenching the aged ingot.

In one embodiment, said isochronally aging the ingot in air is performed with about 25° C. steps lasting about 1 h, from about 150° C. to about 575° C.

In one embodiment, no homogenization step is performed prior to aging to avoid the decomposition of the as-cast supersaturated Al—Mn solid solution.

In one aspect, the invention relates to an aluminum alloy comprising aluminum (Al), manganese (Mn), silicon (Si), and tin (Sn) or indium (In) or antimony (Sb) or bismuth (Bi) or any combinations of tin (Sn) and indium (In) and antimony (Sb) and bismuth (Bi) tin (Sn).

In one embodiment, said manganese comprises about 0.3-0.7 at. % of said aluminum alloy; said silicon comprises about 0.2-1.0 at. % of said aluminum alloy; and said tin or indium or antimony or bismuth or any combinations of tin and indium and antimony and bismuth comprises preferably about 0.01-0.02 at. % of said aluminum alloy.

In one embodiment, the aluminum alloy further comprises an impurity-level concentration of iron (Fe) that is at most about 0.3 at. % of said aluminum alloy.

In one embodiment, the aluminum alloy further comprises at least one of gallium (Ga), copper (Cu), titanium (Ti), vanadium (V), chromium (Cr), zirconium (Zr) and zinc (Zn).

In one embodiment, said iron comprises at most about 0.3 at. % of said aluminum alloy; said gallium comprises at most about 0.01 at. % of said aluminum alloy; said copper comprises about 0.01-0.1 at. % of said aluminum alloy; said titanium comprises at most about 0.01-0.11 at. % of said aluminum alloy; said vanadium comprises at most about 0.01-0.05 at. % of said aluminum alloy; said chromium comprises at most about 0.1 at. % of said aluminum alloy; said zirconium comprises at most about 0.01-0.1 at. % of said aluminum alloy and said zinc comprises about 0.01-0.3 at. % of said aluminum alloy.

In yet another aspect of the invention, the method for producing an aluminum alloy, comprising forming a molten mass of aluminum comprising additions of manganese (Mn), silicon (Si) and tin (Sn) or indium (In) or antimony (Sb) or bismuth (Bi) or any combinations of tin (Sn) and indium (In) and antimony (Sb) and bismuth (Bi); and casting the molten mass to form an ingot.

In one embodiment, said forming the molten mass comprises providing a first molten mass of aluminum held at a first temperature of about 650-900° C.; and adding tin, antimony, indium, bismuth (alone or in combination) and a series of master alloys sequentially to the first molten mass with a holding time of about 10-20 min between each addition to produce a second molten mass, wherein the series of master alloys comprises Al-10Mn and Al-12Si (at. %), and wherein the Al-10Mn master alloy was preheated at a second temperature of about 500-600° C.

In one embodiment, said casting the molten mass to form the ingot comprises maintaining the second molten mass at the first temperature for about 0.5-1.5 h, periodically stirring and then casting the second molten mass into a mold to form an ingot, wherein the mold is preheated at a third temperature of about 100-300° C., and placed on an ice-cooled copper platen immediately prior to casting, to enhance directional solidification.

In one embodiment, the method further comprises isochronally aging the ingot in air, and water quenching the aged ingot.

In one embodiment, no homogenization is performed prior to aging to avoid the decomposition of the as-cast supersaturated Al—Mn solid solution, which simplifies the heat treatment step and reduces the manufacturing costs.

The method disclosed for the creation of the nanoscale α-precipitates can also be utilized to increase the recrystallization resistance of wrought aluminum alloys, enhancing their formability, workability and mechanical properties at ambient and high temperatures, after exposure to very high temperatures.

According to the above-described aspects, the invention has advantageous effects. For example, the disclosed alloys exhibit much higher strength and creep resistance at high temperatures when compared to the commercially available aluminum alloys. The alloys can be exposed to high temperatures and retain their strength at low temperatures (enhanced brazeability and recrystallization resistance). They are also compatible with the Al—Si brazing materials.

Unlike many other aluminum alloys, silicon diffusion from the brazing material into the microstructure of these alloys does not alter the microstructure and mechanical properties significantly. Additionally, the alloys with improved brazability can be utilized in manufacturing heat exchangers with much thinner and stronger fins, tubes and other components, which can operate at higher temperatures and thus enhanced efficiency.

The addition of Sn is small and thus inexpensive; importantly, it is below the impurity levels, which are tolerated in the specification of current Al—Mn alloys. Thus, the Sn modification of an existing alloy family (Al—Mn-based) does not necessitate recertification of these alloys but can be implemented at a minimal cost (a few pennies per pound of aluminum for Sn), utilizing traditional heat-treatments, while boosting the strength of these alloys at high temperatures. They can displace steel and titanium alloys at a lower overall weight, or it can displace other aluminum alloys allowing for higher temperatures and/or higher stresses. Accordingly, the production cost is significantly lower than the recently developed high-temperature aluminum alloys.

The disclosed alloys can be used in demanding high temperature, high stress applications in automotive applications (such as engine blocks, cylinder heads, pistons, brake rotors) and aerospace applications (for example, heat-exchangers or structural parts near engines). The significantly higher brazing temperature, when compared to the commercially available aluminum alloys, makes the disclosed alloys especially well-suited for use in heat exchanger applications in truck and car diesel engine charge-air-coolers as well as other brazed aluminum heat exchangers.

Among other things, the use of the alloy disclosed herein can lead to: (i) increased efficiency of the engines by operating at higher temperatures and stresses, and thus reduced gas consumption and emissions; (ii) increased lifetime of the components under creep conditions, which can lead to a significant economic benefit; (iii) lightweight in automobile and aerospace industries, by replacing heavy steel or titanium parts, with a much lighter Al alloy; and (iv) improved performance of the heat exchangers due to an improvement in the ambient and high-temperature strength and fatigue lifetime There is no need for post-fabrication heat treatments leading to the ease of fabrication and reduced manufacturing costs.

These and other aspects of the invention are further described below. Without intent to limit the scope of the invention, exemplary instruments, apparatus, methods, and their related results according to the embodiments of the invention are given below. Note that titles or subtitles may be used in the examples for convenience of a reader, which in no way should limit the scope of the invention. Moreover, certain theories are proposed and disclosed herein; however, in no way they, whether they are right or wrong, should they limit the scope of the invention so long as the invention is practiced according to the invention, without regard for any particular theory or scheme of action.

EXAMPLE

Enhanced Age-Hardening Response and Creep Resistance of an Al-0.5Mn-0.3Si Alloy (at. %) by Sn Inoculation In the exemplary example, the possibility of improving the aging response of an Al-0.5Mn-0.3Si (at. %) model alloy is explored by microalloying it with Sn, which forms nanoscale Sn clusters in the Al(f.c.c.) lattice. These clusters can act as nucleation sites for α-Al(Mn,Fe)Si precipitates, thus increasing their high number density and strengthening efficiency. The effects of Sn microalloying on the high-temperature strength of the alloy are also investigated utilizing compressive creep experiments.

Specifically, precipitation-strengthening at ambient and high temperatures are investigated in Al-0.5Mn-0.3Si (at. %) alloys with and without 0.02 at. % Sn additions. Isochronal aging experiments reveal that Sn microalloying results in a pronounced age-hardening response: a hardening increment of 125 MPa, with respect to the as-cast state, is achieved at peak-aging, which is about five times higher than that of the Sn-free alloy, 25 MPa. Scanning electron microscopy, transmission electron microscopy and synchrotron x-ray diffraction analyses demonstrate that while the identity (composition and crystal structure) of the α-Al(Mn,Fe)Si precipitates formed in the peak-aged alloys is identical, their mean radii are much smaller (<25 nm vs. 0.2-1 m) and the number densities are much higher (about $10^{22}$ $m^{-3}$) in the Sn-modified alloy. Atom-probe tomographic (APT) analyses revealed that the refinement of the α-precipitate distribution is related mainly to the formation of the Al—Sn nanoprecipitates at intermediate temperatures, which help heterogeneous nucleation of α-precipitates. At about 300° C., creep threshold stresses are observed in both alloys in the peak-aged state, indicative of a climb-controlled bypass mechanism. The threshold stress increases from about 30 MPa in the Sn-free alloy to about 52 MPa in the Sn-modified alloy, which is consistent with its enhanced aging response (higher Orowan stress). The enhanced strength of the Sn-modified alloy is attributed to the refinement of its α-Al(Mn,Fe)Si precipitate radius distribution.

EXPERIMENTAL PROCEDURES

To demonstrate the effect of Sn micro-additions on the precipitation of the α-precipitates, two model alloys, a Sn-free Al-0.5Mn-0.3Si (at. %) (reference alloy) and Sn-modified Al-0.5Mn-0.3Si-0.02Sn (at. %), as listed in Table 1, were prepared in a graphite crucible in an electric resistance heated furnace by adding to a melt of about 99.99% Al, held at about 900° C., about 99.99% Sn and a series of master alloys: sequentially, Al-10Mn and Al-12Si (at. %), with a holding time of about 15 min between each addition. The Al-10Mn master alloy was preheated at about 600° C. After Si additions, the melt was maintained at about 900° C. for about 1 h, periodically stirred, and then cast into a graphite mold preheated at about 200° C., which was placed on an ice-cooled copper platen immediately prior to casting, to enhance directional solidification. The chemical composition of the cast alloys (see Table 1) was determined by inductively coupled plasma optical emission spectroscopy (ICP-OES) at Genitest (Montreal, Canada). All alloys contain impurity-level concentrations of Fe (<0.01 at. %). The as-cast ingots were cut into smaller samples, which were aged isochronally (with about 25° C. steps lasting about 1 h, from about 150° C. to about 575° C.) in air, terminated by water quenching. No homogenization step was performed prior to aging to avoid the decomposition of the as-cast supersaturated Al—Mn solid solution.

TABLE 1

Chemical composition of the alloys determined by inductively coupled plasma optical emission spectroscopy (ICP-OES). AMS stands for Aluminum-Manganese-Silicon

| | | Composition | | | | | | | | |
|---|---|---|---|---|---|---|---|---|---|---|
| Alloy | | Mn | Si | Fe | Ga | Cu | Sn | Ti | V | Zn |
| Al—0.5Mn—0.3Si | (at. %) | 0.50 | 0.35 | 0.004 | <0.001 | 0.004 | <0.0007 | <0.0006 | <0.0005 | 0.0012 |
| (AMS) | (wt. %) | 1.01 | 0.36 | 0.009 | <0.003 | 0.009 | <0.003 | <0.001 | <0.001 | 0.003 |
| Al—0.5Mn—0.3Si—0.02 Sn | (at %) | 0.51 | 0.32 | 0.004 | <0.001 | 0.003 | 0.025 | <0.0006 | <0.0005 | 0.0012 |
| (AMS—Sn) | (wt %) | 1.04 | 0.33 | 0.008 | <0.003 | 0.007 | 0.108 | <0.001 | <0.001 | 0.003 |

Vickers microhardness measurements (about 10 measurements in five different grains for each sample) were performed on polished samples using a Duramin-5 microhardness tester (Struers), with a load of about 200 g and a dwell time of about 5 s. Electrical conductivity measurements were performed utilizing a Sigmatest 2.069 eddy current instrument (Foerster Instruments, Pittsburgh, PA) on samples 11 mm in diameter and 2 mm thick. For each sample, five measurements were performed at about 120, 240, 480, and 960 kHz and an average value was reported.

For scanning electron microscope (SEM) analyses, specimens were ground with a series of SiC grinding papers and then polished with diamond suspensions (about 1-6 μm) followed by vibratory polishing with a colloidal silica solution (about 0.06 μm). An FEI Quanta 650 field-emission-gun SEM equipped with an Oxford *INCA* energy-dispersive-spectroscopy (EDS) detector was used for microstructural investigations.

Transmission electron microscopy (TEM) foils of the aged samples were prepared by mechanical grinding and electropolished to electron transparency using a Struers Tenupol-5 twin-jet polisher and a solution of 10% nitric acid in ethanol at −10° C. Conventional bright-field TEM imaging was performed utilizing a cold-field emission S/TEM instrument, JEOL ARM300F, operating at 300 kV.

Nanotips for three-dimensional (3-D) atom-probe tomography (APT) investigations were prepared by cutting about 0.3×0.3×10 $mm^3$ blanks of the aged samples, followed by a two-step electropolishing technique. Tomographic 3-D APT experiments were performed utilizing a laser-pulsed LEAP 5000XS tomograph (Cameca Instruments Inc., Madison, WI) at a specimen temperature of about 30 K in ultrahigh vacuum ($<10^{-8}$ Pa). Picosecond ultraviolet (UV) laser pulses (wavelength=355 nm) were applied with an energy of about 30 pJ per pulse and a pulse repetition rate of about 500 kHz, while maintaining an average detection rate of about 4%. Data analyses were performed using the program IVAS 3.8.2 (Cameca, Madison, WI). LEAP tomographic datasets were reconstructed using the voltage history during the evaporation. For each dataset, the image compression factor (ICF) was adjusted by indexing all the crystallographic poles observed on the detector hit maps and using the procedure given by B. Gault et al. [30, 31]. The initial nanotip radius was also adjusted to obtain accurate aluminum interplanar spacings for the specific crystallographic poles observed. The proximity histogram methodology was employed to study the compositional variations within the precipitates and the matrix, after performing background corrections to improve the accuracy of the compositional measurements. The effect of Sn on the nucleation of the α-precipitates is studied, employing the nearest neighbor (NN) distribution and the partial radial distribution function (p-RDF) methodologies, applied to the APT datasets, which reveal the solute atom distribution state with the Al(f.c.c.) matrix and provide a measure of solute-solute correlations/clustering. For these analyses, the precipitates, as well as the crystallographic poles and zone lines running throughout the APT volume are excluded from the calculations to limit the analyses to the Al(f.c.c.) matrix and avoid artifacts (artificially high-concentrations of solute atoms, as noted) associated with the surface migration of ions during the field evaporation of a nanotip. A p-RDF at a radial distance, r, is defined as the average concentration of solute species i within a distance of r and r+dr away from a given solute species j, $\langle C_i^j(r)\rangle$, normalized by the overall concentration of the solute species i, $C_i^o$, in the volume:

$$p-RDF=\frac{\langle c_i^j(r)\rangle}{c_i^o}=\frac{1}{c_i^o}\sum_{k=1}^{N_j}\frac{N_i^k(r)}{N_{tot}^k(r)}, \quad (1)$$

where $N_i^k(r)$ is the number of i atoms in a radial shell around the $k_{th}$ j atom, $N_{tot}^k(r)$ is the total number of atoms in the shell, and $N_j$ is the total number of j atoms in the volume analyzed. The average concentration distributions are measured with dr=0.3 nm-thick shells, and only the p-RDF for r>0.2 nm are presented, due to possible ion trajectory effects during field evaporation. The p-RDF values of unity describe perfectly random distributions.

High-brilliance synchrotron X-ray diffraction (XRD) scans were performed on the peak-aged Al-0.5Mn-0.3Si-0.02Sn specimen polished to a final polish of about 1 m at the 5-IDB beamline at the Advanced Photon Source (Argonne National Laboratory, Argonne, IL, USA). Scans were performed from 2θ ranging from about 100 to about 40° using a step size of about 0.010°, a count time of about 4.2 s per step, and a wavelength of about 0.71 Å.

Compressive creep experiments were performed at 300±2° C. under step loadings in air. Cylindrical specimens (about 11 mm in diameter and about 22 mm in height) were placed between boron-nitride-lubricated tungsten carbide platens. Sample deformation was measured with a linear variable differential transducer (LVDT, with a resolution of about 10 μm). After the establishment of a steady-state minimum strain rate for a given load, the applied load was increased, and the process was repeated until the total strain reached about 10% for each specimen.

Results and Discussions

Isochronal Aging

FIGS. 1A-1B display the isochronal (1 h-25° C. steps) aging curves of the Sn-modified Al-0.5Mn-0.3Si-0.02Sn and Sn-free Al-0.5Mn-0.3Si alloys, labelled AMS-Sn and AMS, respectively. The Sn-free alloy exhibits no significant age-hardening, FIG. 1A. Two small peaks in the microhardness values, each with ΔHV~25 MPa with respect to the as-cast microhardness, are observed; the first peak occurs at about 150° C., which is attributed to the precipitation of Si (diamond cubic) precipitates as Mn remains in the supersaturated solid-solution due to its extremely small diffusivity at this temperature [the root-mean-square (RMS) diffusion distance of Mn at about 200° C. is less than about 0.1 nm], which is corroborated by the extremely small changes in the electrical conductivity of the alloy below about 300° C., as displayed in FIG. 1B. The second broader peak at about 425-475° C. is attributed to the formation of the Mn-rich precipitates, substantiated by a significant increase in the electrical conductivity value above 375° C. due to the decomposition of the Al—Mn solid-solution.

In contrast, the Sn-modified alloy exhibits a pronounced age-hardening. Precipitation commences at about 325° C. and accelerates dramatically above about 375° C. as corroborated by sharp increases in the conductivity and microhardness values. This alloy achieves a peak microhardness value of 525±5 MPa at 475° C., above which the microhardness decreases due to the coarsening and dissolution of the precipitates. This value can be increased by adjusting the Si and Zr concentrations. For example, another variant of the Sn-modified alloy with about 0.6 at. % Si has a peak microhardness value of about 650 MPa. Or another variant of the Sn-modified alloy with 0.09 at. % Zr and 0.3Si has a microhardness value of about 725 MPa. It is anticipated to achieve a peak microhardness value of up to 1000-1200 MPa in this alloy system.

The electrical conductivity of both of the Sn-modified and Sn-free alloys is much smaller than pure aluminum (about 17 vs about 36 $MS.m^{-1}$), FIG. 1B, which is consistent with strong electron-scattering by Mn atoms in solid-solution. The effect of about 0.3 at. % Si on the electrical conductivity of aluminum is relatively small (i.e., ~<1 $MS.m^{-1}$ decrease in the conductivity of Al). The conductivity measurements, FIG. 1B, indicate that the overall precipitation kinetics of the Sn-modified Al-0.5Mn-0.3Si-0.02Sn alloy is slightly faster than its Sn-free counterpart at above 375° C., where the Mn diffusivity in Al becomes significant (the RMS diffusion distance >140 nm), the increase in the conductivity of the Sn-modified alloy occurs at a slightly higher rate when compared to the Sn-free alloy.

Aged Microstructure

Figure 2B:
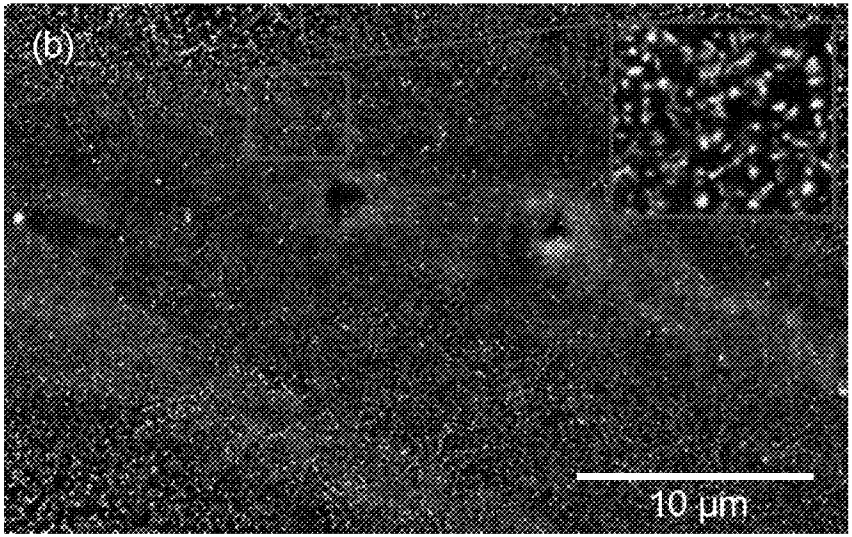
FIGS. 2A-2B show backscattered electron-SEM micrographs of (FIG. 2A) Sn-free Al-0.5Mn-0.3Si alloy and (FIG. 2B) Sn-modified Al-0.5Mn-0.3Si-0.02Sn alloys peak-aged isochronally (475° C.) from the as-cast state, according to embodiments of the invention. Tin micro-additions reduce very strongly the size and also improve the distribution of the α-precipitates. The α-precipitates in Al-0.5Mn-0.3Si-0.02Sn are barely large enough to be resolved by SEM.
Figure 2A:
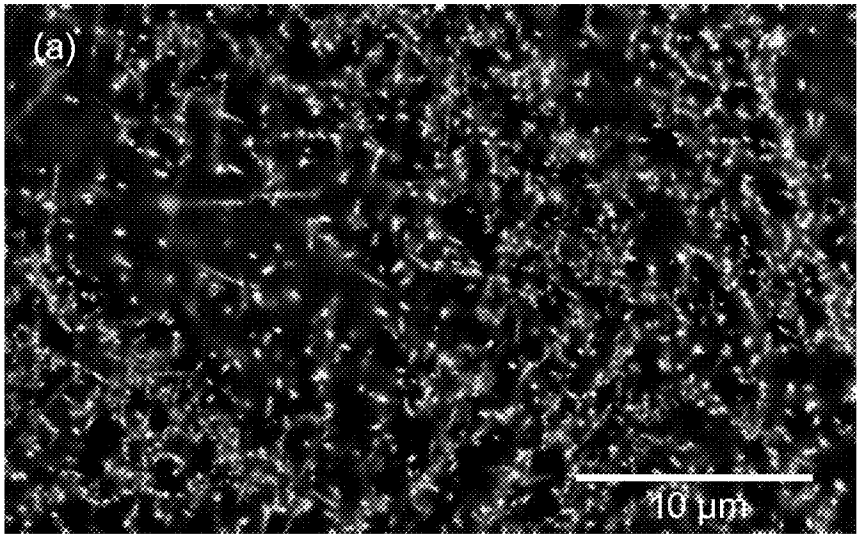
Figure 3:
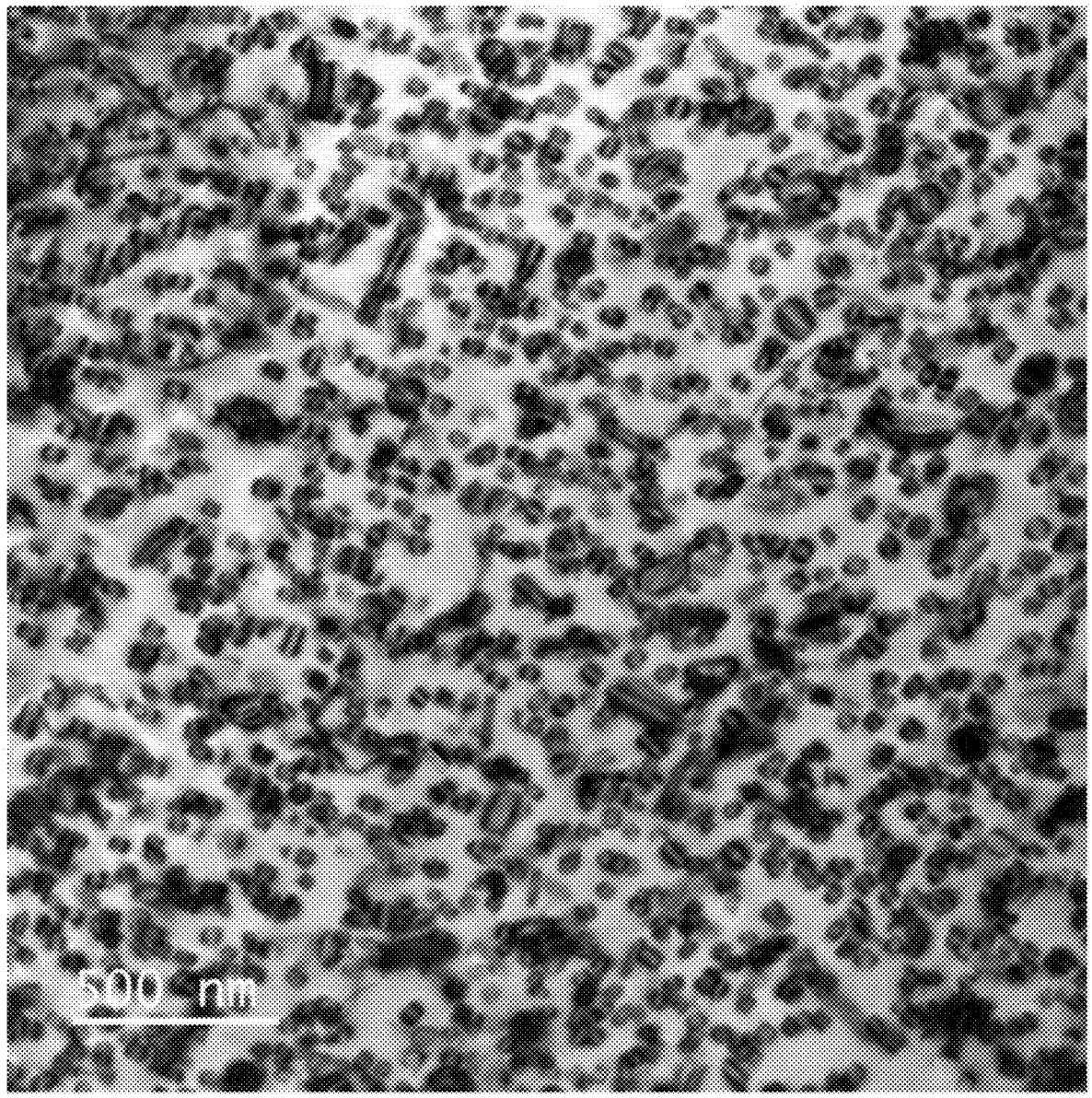
FIG. 3 shows a bright-field transmission electron microscopy (BF-TEM) micrograph of a Sn-modified Al-0.5Mn-0.3Si-0.02Sn alloy peak-aged isochronally to 475° C., displaying the refined distribution of α-precipitates due to Sn modifications, according to embodiments of the invention.
Figure 4:
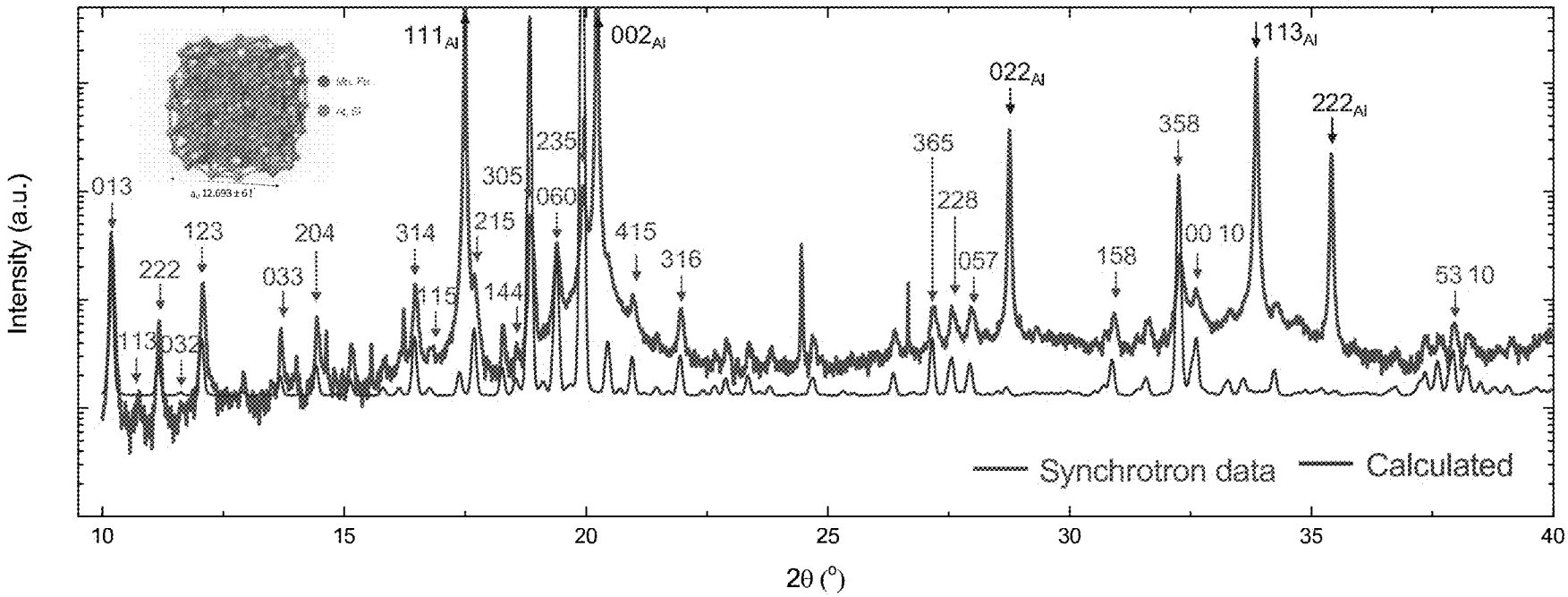
FIG. 4 shows synchrotron XRD spectrum of theAl-0.5Mn-0.3Si-0.02Sn alloy peak-aged isochronally to about 475° C., displaying the reflections of the Al(f.c.c.) and α-Al(Mn,Fe)Si phases, according to embodiments of the invention. The superimposed spectrum (red) is for the α-phase calculated utilizing the crystal data of Ref. [17] and CrystalDiffract software. Some of the reflections of the α-phase are not indexed for brevity. Weak reflection lines with odd h+k+l are indicative of a simple cubic lattice (space group Pm3) for the α-phase. The lattice parameter is determined to be $a_o$=12.64±0.01 Å. The inset is a unit cell of the simple cubic α-phase generated using the atomic coordinates of Ref [17] with 138 atoms in the cubic unit cell and the Jmol software.

Upon aging of the as-cast alloys to their respective peak microhardnesses at about 475° C., Mn—Si-rich precipitates, determined by EDS analyses, are formed in both alloys, FIGS. 2A-2B. In the Sn-free Al-0.5Mn-0.3Si alloy, FIG. 2A, the precipitates are coarse (radii being about 100 to 500 nm) and distributed non-uniformly within the microstructure. In the Sn-modified Al-0.5Mn-0.3Si-0.02Sn alloy, FIG. 2B, the precipitates are, however, dramatically smaller (radii being about 25 nm) and distributed uniformly, as confirmed by TEM analyses in FIG. 3. Synchrotron XRD was utilized to identify the crystal structure of the precipitates. FIG. 4 shows the XRD pattern of the peak-aged Sn-modified Al-0.5Mn-0.3Si-0.02Sn alloy. Reflections of Al(f.c.c.) and a second phase with a large lattice parameter were identified. All the reflections of the second phase can be indexed on the basis of a simple cubic (SC) lattice, with a space group of Pm3. The reflection lines with odd values of h+k+1 are weak, which indicates a small deviation from a body-centered cubic (b.c.c.) structure, typical of a simple cubic α-Al—Mn—Si approximant-phase with small Fe concentrations. Excellent agreement is found between the observed reflection lines of the second phase and those of an α-Al—Mn—Si phase calculated utilizing the crystal data of Ref. [17]. The lattice parameter is then determined to be $a_o$=12.64 0.01 Å, in good agreement with the values reported for an α-Al—Mn—Si phase in Ref. [17], $a_o$=12.68 Å and Ref. [35], $a_o$=12.643 Å.

APT Analyses of the Sn-Rich-Nanoprecipitates and α-Precipitates

To study the effect of Sn microalloying on the nucleation mechanism of the α-precipitates in the Al-0.5Mn-0.3Si-0.02Sn alloy, APT analyses were performed on the specimens aged isochronally to about 200° C. and about 475° C. (peak microhardness). These heat treatment conditions have been chosen based on the diffusivities of Sn (a fast diffuser) and Mn (a slow diffuser) in aluminum as well as the aging response of the alloy, FIGS. 1A-1B.

Figure 5A:
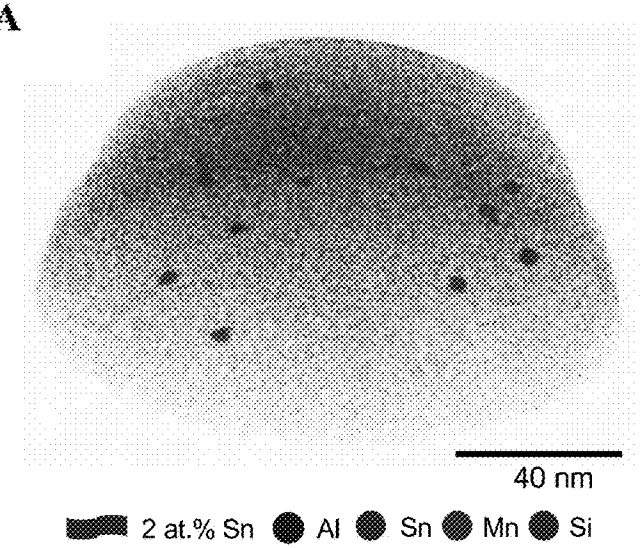
FIG. 5A shows atom-probe tomographic (APT) reconstructions of the Al-0.5Mn-0.3Si-0.02Sn alloy aged isochronally to 200° C. from the as-cast state (FIG. 1A), displaying Sn-rich nanoprecipitates with a mean radius, <R>, of 1.5 nm, according to embodiments of the invention. The total number of atoms collected is 70 million.
Figure 5B:
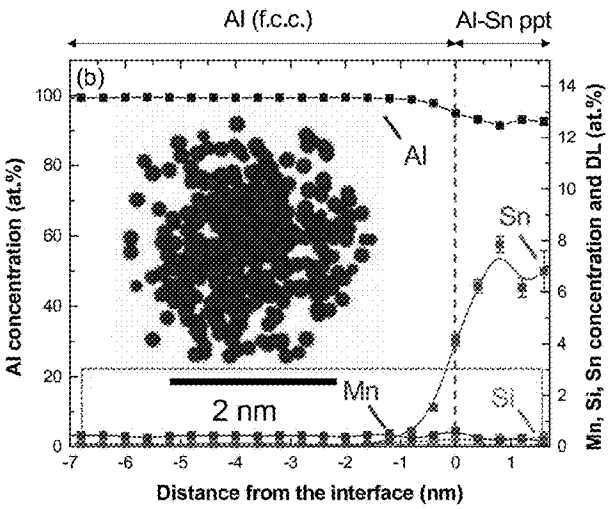
FIG. 5B shows proximity histograms computed from the nanotip displayed in FIG. 5A, displaying the average concentration profiles across the matrix/precipitate heterophase interface. This interface (vertical red dashed-line) is defined as the inflection point of the Al concentration-profile. The error bars represent a one-sigma statistical error (some error bars are smaller than the marker size).
Figure 5C:
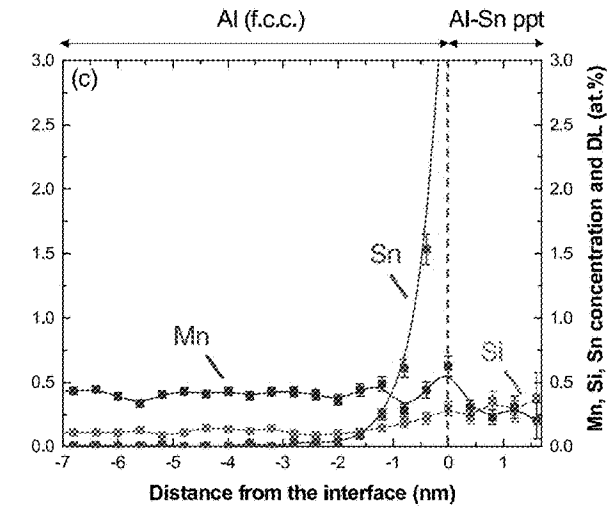
FIG. 5C shows an enlarged view of the boxed area in FIG. 5B.

Formation of Sn-rich nanoprecipitates: FIG. 5A displays the nanostructure of the Al-0.5Mn-0.3Si-0.02Sn alloy aged isochronally to about 200° C. Tin-rich nanoprecipitates with a mean radius, <R>, of about 1.5 nm are observed within the Al(f.c.c.) matrix. The corresponding proximity histogram, FIGS. 5B-5C, provides radial concentration profiles across the matrix/nanoprecipitate heterophase interface averaged over all 12 nanoprecipitates in the 3-D reconstructed volume of matter, FIG. 5A. Tin is the main constituent of the nanoprecipitates. Silicon partitions to the nanoprecipitates at a dimensionless partitioning ratio (at. %/at. %)) of $k_{Si}^{Sn\text{-}Ppt/Al(f.c.c.)}=C_{Si}^{Sn\text{-}Ppt}/C_{Si}^{Al(f.c.c.)}\approx 2$, where $C_{Si}^{Sn\text{-}Ppt}$ and $C_{Si}^{Al(f.c.c.)}$ are the concentrations of Si (at. %) in the Sn-rich nanoprecipitates and the Al(f.c.c.) matrix, respectively. Manganese partitions weakly to the Al(f.c.c.) matrix, $k_{Mn}^{Sn\text{-}Ppt/Al(f.c.c.)}\sim 0.6$. The average composition of the nanoprecipitates is $Al_{88}Sn_6Si_{0.3}Mn_{0.3}$ (atomic fraction). No Mn-rich precipitates were observed, which is consistent with the extremely small diffusivity of Mn at about 200° C.

Figure 6B:
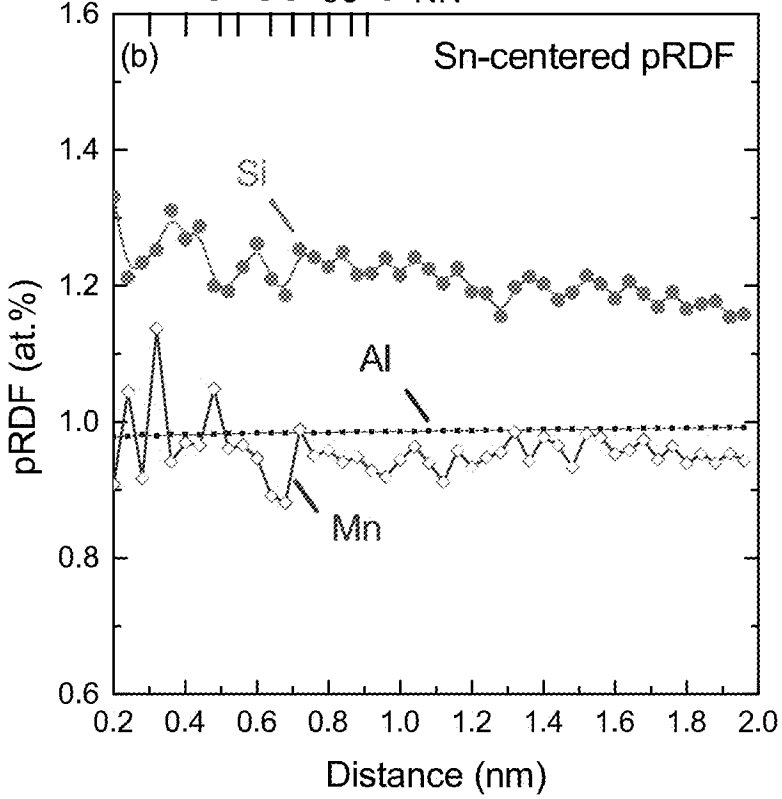
FIG. 6B shows a partial radial distribution function (p-RDF) centered on the Sn-atoms displaying strong Sn—Si correlations and no significant Sn—Mn interactions in the Al(f.c.c.) matrix.
Figure 6A:
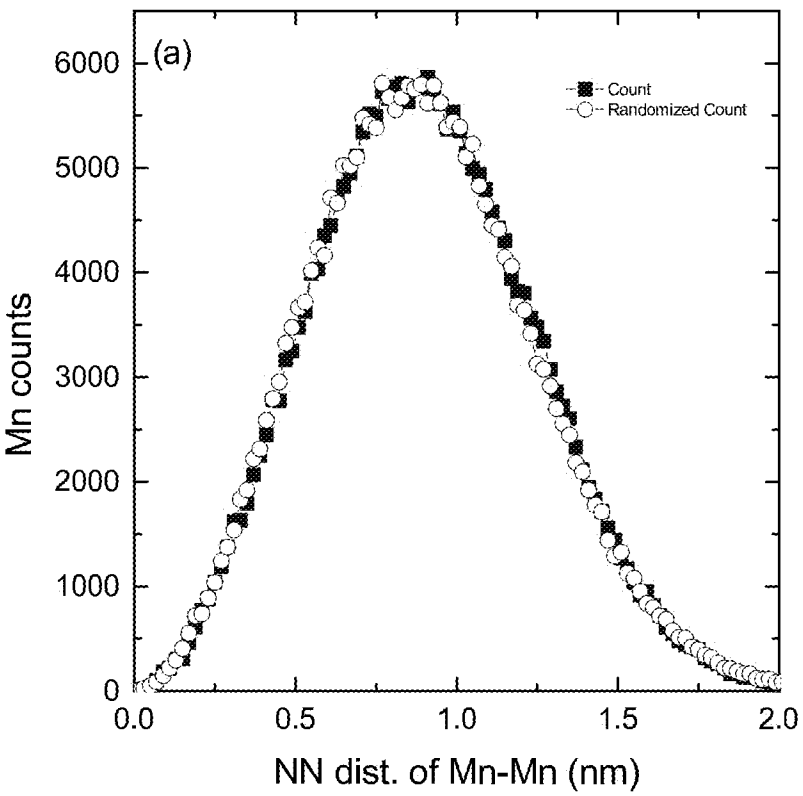
FIG. 6A shows a plot of nearest neighbor (NN) distances of the Mn solute atoms in the Al-0.5Mn-0.3Si-0.02Sn alloy aged isochronally to 200° C. 25 M atoms were analyzed, according to embodiments of the invention. No significant clustering of the Mn solute atoms is detected, as demonstrated by the identical measured and calculated randomized-distribution of this element.

FIG. 6A displays the Mn—Mn nearest-neighbor (NN) distribution analyses within the Al(f.c.c.) matrix of the same Al-0.5Mn-0.3Si-0.02Sn alloy shown in FIG. 5A. The measured Mn—Mn NN-distribution exhibits no statistically significant deviation from the anticipated random distribution, indicating that, within the detection limit of a few atoms, no Mn clustering occurs within the Al(f.c.c.) matrix. This is in agreement with the prior experiments on a Sn-free Al—Mn based alloy in which we found no evidence of Mn clustering in the temperature range about 300-450° C. Thus, the Sn addition seems to have no influence on the distribution of the Mn solute atoms within the Al(f.c.c.) matrix at about 200° C. Partial RDF (p-RDF) analyses shown in FIG. 6B were also performed on the same specimen in FIG. 5A. No significant Sn—Mn correlations exist, as demonstrated by the Sn—Mn p-RDF values fluctuating around unity over the first 2 nm radial distance from the Sn atoms. A strong Sn—Si correlation, p-RDF greater than unity is, however, observed.

Figures 7A, 7B, 7C:
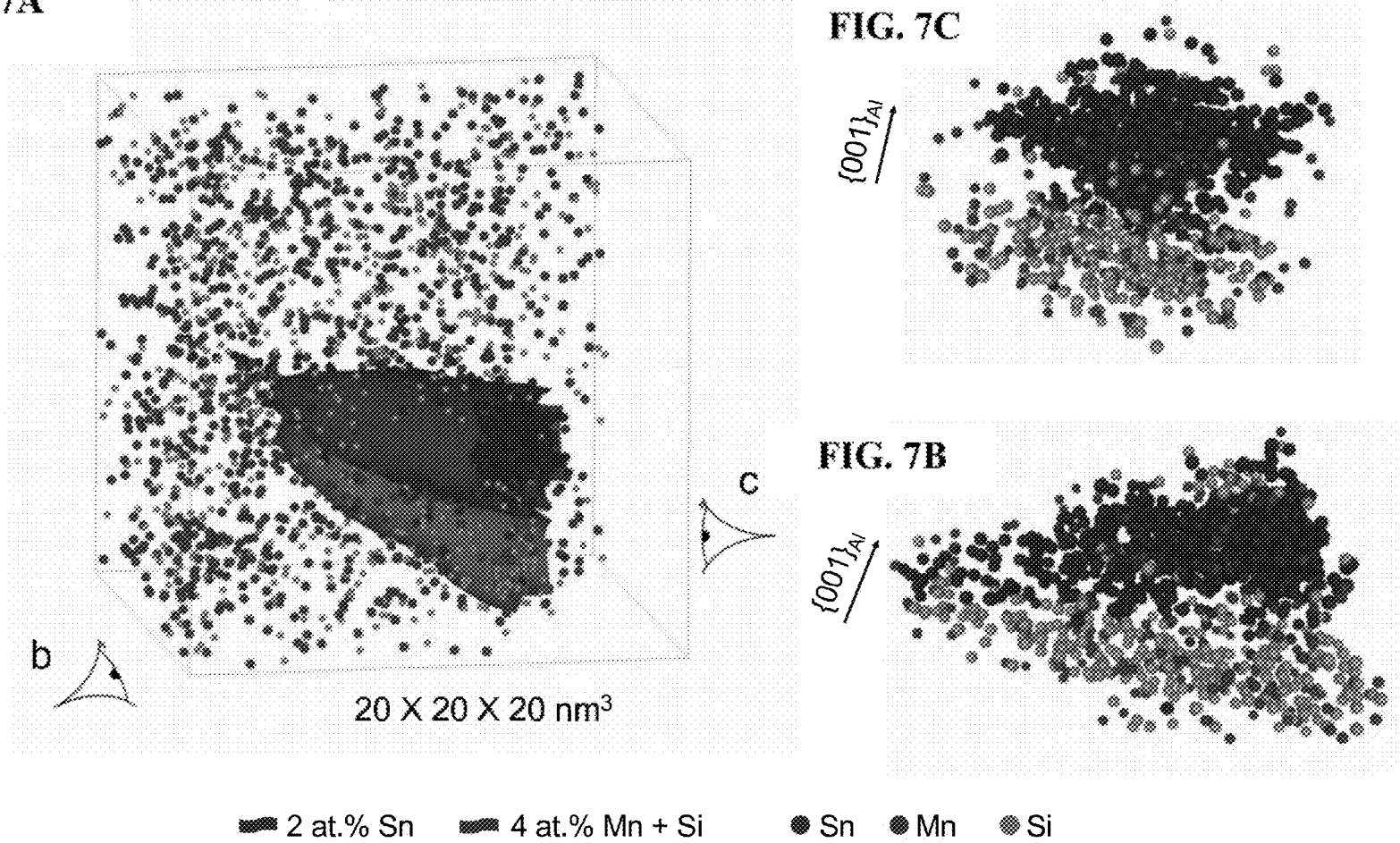
FIGS. 7A-7C show heterogeneous (piggyback) nucleation of a Mn—Si-rich precipitate (precursor to an α-precipitate) on an Sn-rich nanoprecipitate in an Sn-modified Al-0.5Mn-0.3Si-0.02Sn alloy aged isochronally to 300° C., according to embodiments of the invention.

Heterogeneous (piggyback) nucleation of the α-precipitates: FIG. 7A displays the APT reconstruction of an Sn-modified specimen aged isochronally to 300° C. A segment of a Mn—Si-rich nanoprecipitate (α-precipitate or its precursor) associated with a Sn-rich nanoprecipitate is imaged in this nanotip. The distribution of the alloying elements (Sn, Mn and Si) within the two nanoprecipitates are displayed in FIGS. 7B-7C. The association of the Mn—Si-rich nanoprecipitates (precursors of the α-precipitates) with the Sn-rich nanoprecipitate is consistent with a heterogeneous nucleation mechanism, through which the α-precipitates (or their precursors) nucleate on the Sn-rich nanoprecipitates (piggyback nucleation with an appendage morphology), which are formed at a lower temperature, FIG. 5A. The average composition of the Sn-rich nanoprecipitates at 300° C. is: ~50 at. % Sn, ~0.2 at. % Si and ~0.1 at. % Mn. The Sn concentrations in the Al(f.c.c.) matrix and the Mn—Si-rich nanoprecipitate are negligible (<10 at. ppm).

Creep Behavior at 300° C.

Figure 8:
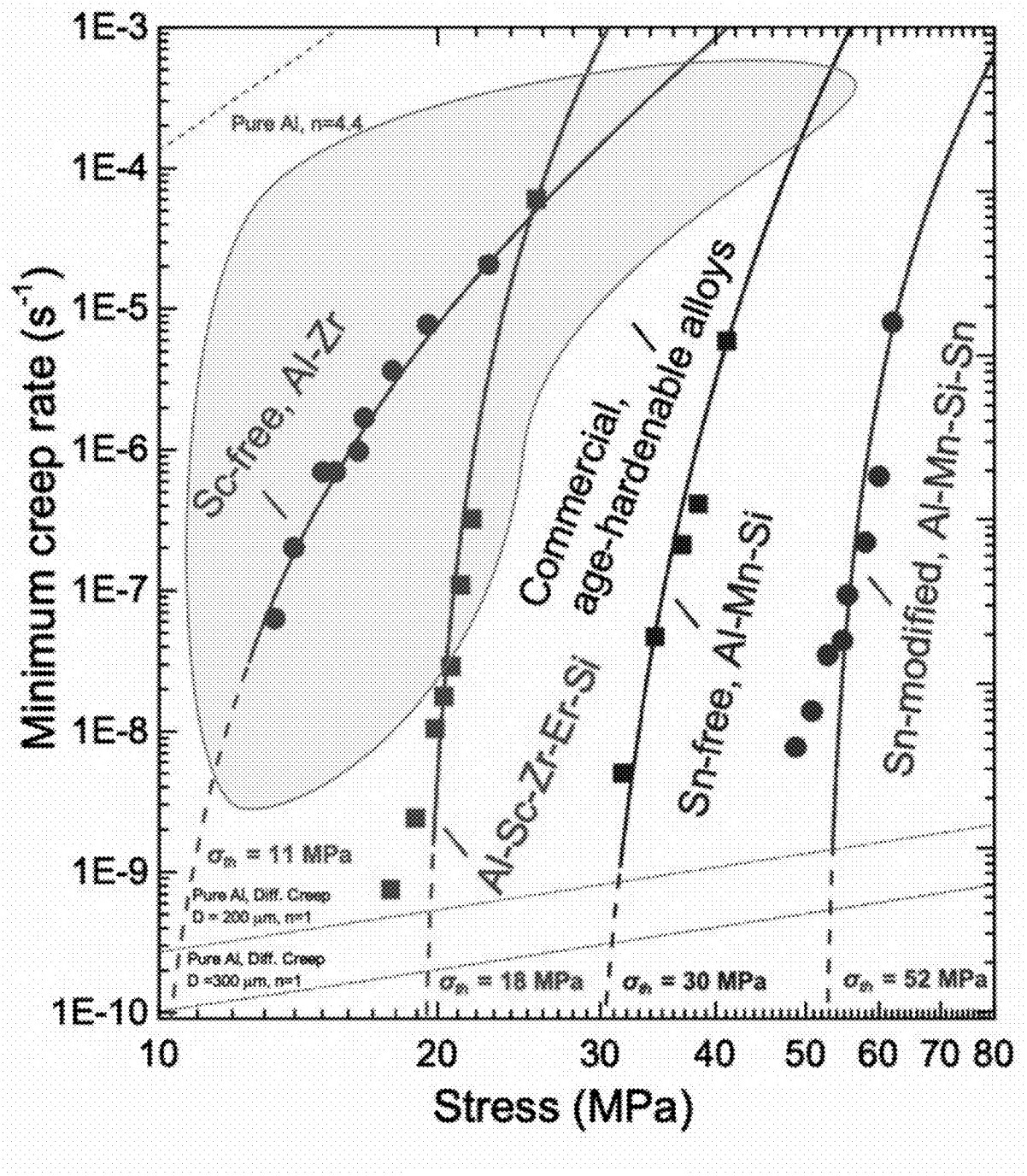
FIG. 8 displays a double-logarithmic plot of the minimum compressive strain rate vs. applied stress at about 300° C. for the Sn-free Al-0.5Mn-0.3Si and Sn-modified Al-0.5Mn-0.3Si-0.02Sn alloys containing α-precipitates, according to embodiments of the invention. Also plotted are two $L1_2$-strengthened alloys: Sc-free, A1-0.11Zr-0.005Er-0.02Si [9] and Sc-containing, Al-0.08Zr-0.014Sc-0.008Er-0.10Si [11]. The shaded area represents approximately the range of creep rates/stresses observed in commercial aluminum alloys at 300° C., which usually exhibit thermally unstable microstructures, that is, the precipitates either coarsen or dissolve. The dotted red lines (upper left-hand corner) represent calculated dislocation creep rates, and the dotted blue and black lines represent the calculated diffusional (sum of the Coble and Nabarro-Herring creep contributions, for grain sizes of Diam.=200 and 300 m) creep rates for pure aluminum utilizing data in Ref. [37].

Compressive creep tests were performed on the peak-aged Sn-free Al-0.5Mn-0.3Si and Sn-modified Al-0.5Mn-0.3Si-0.02Sn alloys, displaying two widely different sizes and distributions of α-precipitates, FIGS. 2A-2B. FIG. 8 shows plots of the minimum creep rate, $\dot{\varepsilon}_m$, as a function of applied stress, σ, on a double-logarithmic scale for these alloys, along with two $L1_2$-strengthened alloys: Sc-free, Al-0.11Zr-0.005Er-0.02Si [9] and Sc-containing, Al-0.08Zr-0.014Sc-0.008Er-0.10Si [11] for comparative purposes. The apparent stress exponents, $n_a(=\partial \text{ in } \dot{\varepsilon}_m/\partial \text{ in } \sigma)$, in the dislocation creep regimes are much higher than that for pure Al (n=4.4) [37], and vary with stress ($n_a$~25-30), which is indicative of a threshold stress, $\sigma_{th}$, below which dislocation creep is inhibited [8]. The threshold stresses are attributed to the interaction of dislocations with precipitates during the climb bypass process [39, 40]. The threshold stresses vary with precipitate fractions and sizes and with the matrix/precipitate lattice parameter mismatch, as reported for several aluminum alloys strengthened with coherent L12 nanoprecipitates [7, 10, 41], α-precipitates [15, 16, 42], and other dispersion-strengthened alloys [38, 43-45]. In the presence of a threshold stress, $\sigma_{th}$, the minimum creep rate, $\dot{\varepsilon}_m$, is expressed through a modified power-law equation [38]:

$$\dot{\varepsilon}_m = A(\sigma - \sigma_{th})^n \exp\left(-\frac{Q}{kT}\right); \quad (2)$$

where n is the stress exponent for the aluminum matrix, A is a constant, Q is the creep activation energy and kT has its standard meaning. The threshold stresses, determined employing a best-fit procedure given in Ref. [46], are given in FIG. 8. It is apparent that the Sn-modified alloy, with very small α-precipitates, exhibits a threshold stress of about 52 MPa, which is much greater than that of the Sn-free alloy, about 30 MPa, with much larger α-precipitates. This significant improvement in the creep resistance is consistent with the pronounced age-hardening response of the Sn-modified alloy, FIG. 1A, making this alloy one of the most creep-resistant high-temperature aluminum alloys developed to date, when compared to the $L1_2$-strengthened alloys as well as the commercial age-hardenable alloys (pink-shaded bubble region, FIG. 8).

Aging Response

Isochronal aging results, FIG. 1A, reveal that the Sn-free alloy derives very little strengthening from the α-precipitates, as demonstrated by a negligible (ΔHV~25 MPa) increase in the microhardness upon aging to 435-475° C.; this is consistent with the coarse radii of the α-precipitates and their small number density (FIG. 2A), which originates from a high activation energy for nucleation. In the Sn-modified alloy, however, a high precipitation-strengthening (ΔHV~125 MPa, about five times as high as the Sn-free alloy) is achieved upon aging, FIG. 1A. This unprecedented strengthening imparted by the α-precipitates is attributed to changes in the nucleation current of the precipitates (the number of nuclei formed per unit volume per unit time) leading to a dramatic increase in their number density and concomitant decrease in their radii, FIGS. 2A-2B. The nucleation mechanism is discussed in the next section. The volume fraction of the α-precipitates is expected to be nearly identical in both peak-aged alloys, given the similar increases in their electrical conductivity values upon aging with respect to the as-cast state (ΔEC 11 and 11.5 $MS.m^{-1}$ for the Sn-free and Sn-modified alloys, respectively, FIG. 1B). These increases in the electrical conductivity are proportional to the concentration of Mn solute atoms removed from the supersaturated solid-solution upon aging, which is directly proportional to the volume fraction of α-precipitates.

Heterogeneous Nucleation of the α-precipitates in Al-0.5Mn-0.3Si-0.02Sn

The synchrotron XRD analyses shown in FIG. 4 reveals that the Sn microalloying does not affect the identity (crystal structure) of the α-precipitate phase formed upon isochronal aging, so that the substantial refinement of their distributions and sizes, FIGS. 2A-2B, appears to be solely responsible for the pronounced aging response of the Sn-modified Al-0.5Mn-0.3Si-0.02Sn alloy, FIGS. 1A-1B. Hence, it is reasonable to assume that the high nucleation rate of the α-precipitates is related to a significantly reduced nucleation barrier in the Sn-modified alloy with respect to the Sn-free reference alloy through a heterogeneous nucleation mechanism. The APT results presented in FIG. 7A provide highly convincing evidence for the heterogeneous (piggyback) nucleation of α-precipitates on the Al—Sn nanoprecipitates, which are formed at lower temperatures, FIG. 5A. It can be ruled out that other heterogeneities [such as Mn or Mn—Sn clusters/co-clusters, or short range ordered (SRO) domains in the Al(f.c.c.) lattice] act as nucleation sites, as the APT analyses reveal directly that Mn solute atoms are randomly distributed in the Al(f.c.c.) matrix, FIG. 6A, and that no significant Mn—Sn correlations exist, FIG. 6B.

Figure 9:
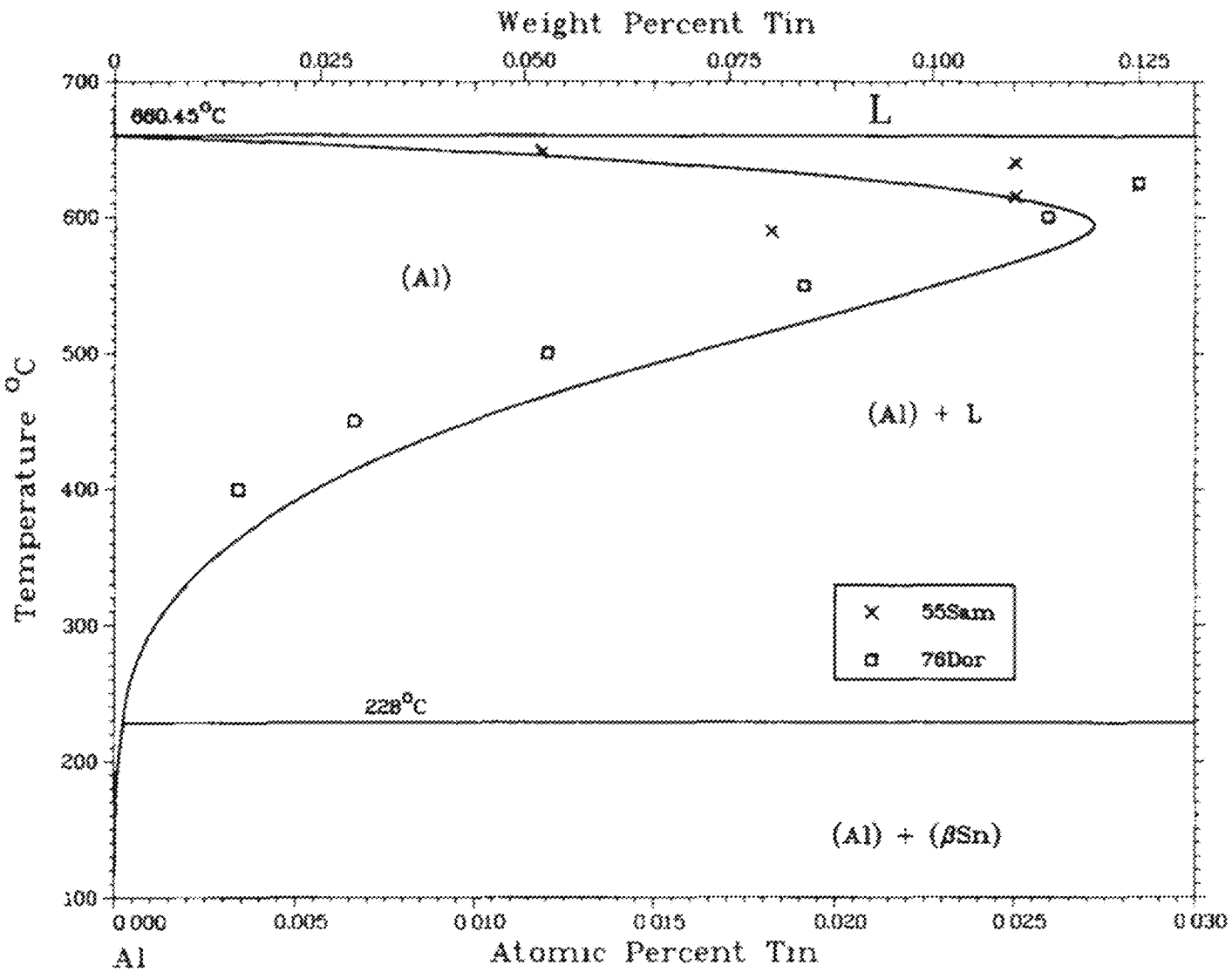
FIG. 9 displays calculated Al-rich solidus compared with experimental data in Refs. [51, 52], redrawn from Ref [47].

It appears that the heterogeneous α-precipitation relies on: (i) the formation of the Al—Sn nanoprecipitates, a novel phase, at low temperatures (below 200° C., FIG. 5A); and (ii) their survival to higher temperatures (as observed, for example at 300° C., FIG. 7A). This survival result is unanticipated, given that the published Al—Sn phase diagrams [47, 48] (FIG. 9) describe phase equilibrium below about 230° C. between solid-Al(f.c.c.) and solid pure-Sn (h.c.p. [47] or b.c.t. [48]) phases, and above this temperature, solid Sn is described to transform into a liquid Sn-rich phase in equilibrium with the solid Al(f.c.c.) phase. According to these phase diagrams and given the extremely large diffusivity of Sn in Al [49], a fast growth, coarsening and eventual dissolution of pure Sn precipitates in the Al(f.c.c.) matrix are anticipated upon isochronal peak-aging, and any excess Sn (above the solubility limit in the Al(f.c.c.) matrix) can be anticipated to reach free surfaces (or grain boundaries) rapidly, forming a liquid film, rather than remaining in the Al(f.c.c.) grain as solid Al—Sn nanoprecipitates, FIG. 7A. Whether small additions of Mn and Si play a significant role in altering the bulk thermodynamic properties of the Al—Sn alloy system is uncertain, which requires further investigations; but it is unlikely, given that the Mn and Si concentrations of the Al—Sn nanoprecipitates are small (~0.3 at. % at 200° C., FIG. 5C). It is, nonetheless, likely that in this alloy system, Al—Sn nanoprecipitates formed at low temperatures are metastable at high temperatures, and their melting kinetics are impeded by the Al(f.c.c.) matrix and/or nucleation of the α-precipitates. A similar superheating phenomenon is observed in a related Al—Pb alloy system [50], which is attributed to the suppression of melt nucleation—thermal vibrations—at the matrix/nanoprecipitate heterophase interface. The metastability of the Sn-rich nanoprecipitates above the melting point of Sn, 231.9° C., is critical for the heterogeneous nucleation of the α-precipitates (FIG. 7A), as below this temperature the Mn diffusivity is extremely small (RMS diffusion distance of Mn<<1 nm), so that heterogenous nucleation is highly unlikely.

Implications for Alloy Design

The Sn inoculation disclosed herein for the refinement of the distribution of the α-Al(Mn,Fe)Si precipitates can be employed in most of the commercial Al alloys containing Mn (3000, 4000, 5000 and 6000 series Al alloys) to improve their strengths at both ambient and elevated temperatures. The modified alloys can be utilized at ambient and high temperatures under high stresses for a variety of light-weight applications. This chemical approach is particularly attractive as Sn micro-additions can be integrated into the bulk composition of the alloys, within the impurity tolerances of most of aluminum alloys. Thus, neither recertification of the alloy systems nor additional processing (such as large deformation steps or complex multistage aging) are necessary. Furthermore, as Sn inoculation appears to be relatively insensitive to the presence of other impurities in Al alloys, such as Fe and Si, Sn inoculation can be employed to alloys with high recycling content (with higher Fe and Si than pristine alloys), which leads to significant financial and environmental benefits. Hence, these new alloys can be considered to be Green aluminum alloys.

CONCLUSIONS

Briefly, the microstructures and mechanical properties of Al-0.5Mn-0.3Si (at. %) alloys with and without 0.02 at. %

Sn additions were examined in the exemplary example. The Sn-modified alloy exhibits a pronounced age-hardening response, unlike the Sn-free alloys and all known Al—Mn-based alloys, leading to high strengths at ambient and high temperatures. The following specific conclusions are drawn:

1. The Sn-modified alloy achieves a peak microhardness value of 525±5 MPa upon isochronal aging to 475° C., corresponding to a significant hardening increment of ~125 MPa as compared to the as-cast state, while the Sn-free alloy exhibits a poor aging response with a small hardening increment of about 25 MPa, FIG. 1A.

2. Upon aging of the as-cast alloys to their respective peak microhardnesses (475° C.), α-Al(Mn,Fe)Si precipitates are formed in both alloys. In the Sn-free Al-0.5Mn-0.3Si alloy, FIG. 2A, the α-precipitates are coarse (radii ~100 to 500 nm) and distributed non-uniformly throughout the microstructures. In the Sn-modified Al-0.5Mn-0.3Si-0.02Sn alloy, FIG. 2B, the α-precipitates are, however, dramatically smaller (radii ~25 nm) and are distributed uniformly.

3. Synchrotron XRD analyses, FIG. 4, reveal that the Sn microalloying does not affect the crystal structure of the α-precipitates formed upon isochronal aging. The α-Al(Mn,Fe)Si phase is determined to have a simple cubic (s.c.) lattice, a space group of Pm3, with a lattice parameter $a_o$ of 12.64±0.01 Å.

4. APT analyses of the specimens aged to 200° C., FIG. 5A, reveal that Sn-rich nanoprecipitates with a mean radius, <R>, of 1.5 nm are formed within the Al(f.c.c.) matrix. No Mn-rich precipitates or heterogeneities were observed at this temperature, consistent with the extremely small diffusivity of Mn in Al.

5. Atom-probe tomographic (APT) results, FIG. 7A, indicate that α-precipitates (or their precursors) nucleate heterogeneously on the Al—Sn nanoprecipitates (at a higher temperature, approximately 300° C.), leading to the refinement of their distribution.

6. The unanticipated survival of the Al—Sn nanoprecipitates at high temperatures (i.e., at 300° C., FIG. 7A) is hypothesized to be related to melt nucleation suppression at the matrix/nanoprecipitate heterophase interface.

7. Compressive creep experiments conducted at 300° C., FIG. 8, demonstrate that the Sn-modified Al-0.5Mn-0.3Si-0.02Sn alloy exhibits a creep threshold stress of ~52 MPa, which is over 70% greater than that of the Sn-free alloy, ~30 MPa.

8. Dramatic improvements in the creep resistance of the Sn-modified Al-0.5Mn-0.3Si-0.02Sn alloy are attributed to a finer distribution of α-Al(Mn,Fe)Si precipitates in agreement with the pronounced age-hardening response of the Sn-modified alloy, FIG. 1A.

9. The significantly higher brazing temperature, when compared to the commercially available aluminum alloys, makes the disclosed alloys especially well-suited for use in heat exchangers, at high temperature, and/or high stress applications in automotive applications, such as truck and car diesel engine charge-air-coolers, as well as other brazed aluminum heat exchangers, engine blocks, cylinder heads, pistons, brake rotors, and aerospace applications, such as heat-exchangers or structural parts near engines. The use of the alloy disclosed herein can lead to: (i) increased efficiency of the engines by operating at higher temperatures and stresses, and thus reduced gas consumption and emissions; (ii) increased lifetime of the components under creep conditions, which can lead to a significant economic benefits; (iii) lightweight in automobile and aerospace industries, by replacing heavy steel or expensive titanium parts, with a much lighter Al alloy; and (iv) improve performance of heat exchangers, by reducing wall thickness that decreases thermal resistance, due to an improvement in the ambient and high-temperature strength and fatigue lifetime. Additionally, there is no need for post-fabrication heat treatments leading to ease of fabrication and thereby reduced manufacturing costs.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described to explain the principles of the invention and their practical applications, so as to enable others skilled in the art to utilize the invention and various embodiments and with various modifications as are suited to the particular use contemplated. Alternative embodiments will become apparent to those skilled in the art to which the invention pertains without departing from its spirit and scope. Accordingly, the scope of the invention is defined by the appended claims rather than the foregoing description and the exemplary embodiments described therein.

Some references, which may include patents, patent applications, and various publications, are cited and discussed in the description of this invention. The citation and/or discussion of such references is provided merely to clarify the description of the invention and is not an admission that any such reference is "prior art" to the invention described herein. All references cited and discussed in this specification are incorporated herein by reference in their entireties and to the same extent as if each reference was individually incorporated by reference.

LIST OF REFERENCES

[1]. F. Qian, S. Jin, G. Sha, Y. Li, Enhanced dispersoid precipitation and dispersion strengthening in an Al alloy by microalloying with Cd, Acta Mater. 157 (2018) 114-125.

[2]. Y. Murakami, K. Mori, Highly supersaturated Al—Mn solid solution alloys and their decomposition by heat-treatment, Journal of Japan Institute of Light Metals 18(6) (1968) 339-346.

[3]. L. F. Mondolfo, Aluminum alloys: structure and properties, Butterworths, London, 1976.

[4]. K. Nagahama, I. Miki, Precipitation during Recrystallization in Al—Mn and Al—Cr Alloys, Transactions of the Japan Institute of Metals 15(3) (1974) 185-192.

[5]. N. J. Luiggi, Isothermal precipitation of commercial 3003 Al alloys studied by thermoelectric power, Metallurgical and Materials Transactions B 28(1) (1997) 125-133.

[6]. L. Lodgaard, N. Ryum, Precipitation of dispersoids containing Mn and/or Cr in Al—Mg—Si alloys, Materials Science and Engineering: A 283(1) (2000) 144-152.

[7]. R. A. Michi, J. P. Toinin, A. R. Farkoosh, D. N. Seidman, D. C. Dunand, Effects of Zn and Cr additions on precipitation and creep behavior of a dilute Al—Zr—Er—Si alloy, Acta Mater. 181 (2019) 249-261.

[8]. A. R. Farkoosh, D. C. Dunand, D. N. Seidman, Tungsten solubility in L12-ordered Al3Er and Al3Zr nanoprecipitates formed by aging in an aluminum matrix, J. Alloys Compd. 820 (2020) 153383.

[9]. A. R. Farkoosh, D. C. Dunand, D. N. Seidman, Effects of W and Si microadditions on microstructure and the strength of dilute precipitation-strengthened Al—Zr—Er alloys, Materials Science and Engineering: A 798 (2020) 140159.

[10]. K. E. Knipling, D. C. Dunand, D. N. Seidman, Criteria for developing castable, creep-resistant aluminum-based alloys—A review, Z. Metallk. 97(3) (2006) 246-265.

[11]. A. De Luca, D. C. Dunand, D. N. Seidman, Microstructure and mechanical properties of a precipitation-strengthened Al—Zr—Sc—Er—Si alloy with a very small Sc content, Acta Mater 144 (2018) 80-91.

[12]. Y. J. Li, L. Arnberg, Quantitative study on the precipitation behavior of dispersoids in DC-cast AA3003 alloy during heating and homogenization, Acta Mater. 51(12) (2003) 3415-3428.

[13]. Y. J. Li, A. M. F. Muggerud, A. Olsen, T. Furu, Precipitation of partially coherent α-Al(Mn,Fe)Si dispersoids and their strengthening effect in AA 3003 alloy, Acta Mater. 60(3) (2012) 1004-1014.

[14]. A. R. Farkoosh, Development of creep-resistant Al—Si cast alloys strengthened with nanoscale dispersoids, McGill University, 2014.

[15]. A. R. Farkoosh, X. G. Chen, M. Pekguleryuz, Dispersoid strengthening of a high temperature Al—Si—Cu—Mg alloy via Mo addition, Mater. Sci. Eng., A 620 (2015) 181-189.

[16]. A. R. Farkoosh, X. G. Chen, M. Pekguleryuz, Interaction between molybdenum and manganese to form effective dispersoids in an Al—Si—Cu—Mg alloy and their influence on creep resistance, Mater. Sci. Eng., A 627 (2015) 127-138.

[17]. M. Cooper, K. Robinson, The crystal structure of the ternary alloy a (AlMnSi), Acta Crystallogr. 20(5) (1966) 614-617.

[18]. A. M. F. Muggerud, Y. Li, R. Holmestad, S. J. Andersen, Mackay icosahedron explaining orientation relationship of dispersoids in aluminium alloys, Acta Crystallographica Section B 70(5) (2014) 888-896.

[19]. Y. Fan, M. M. Makhlouf, Stabilizing the strengthening precipitates in aluminum-manganese alloys by the addition of tungsten, Materials Science and Engineering: A 691 (2017) 1-7.

[20]. M. Vlach, I. Stulikovi, B. Smola, H. Cisarovi, J. Piesovi, S. Danis, R. Gemma, J. Milek, D. Tanprayoon, V. Neubert, Phase transformations in non-isothermally annealed as-cast and cold-rolled AlMnScZr alloys, International Journal of Materials Research 103(7) (2012) 814-820.

[21]. Z. Li, Z. Zhang, X. G. Chen, Effect of Metastable $Mg_2Si$ and Dislocations on α-Al(MnFe)Si Dispersoid Formation in Al—Mn—Mg 3xxx Alloys, Metallurgical and Materials Transactions A 49(11) (2018) 5799-5814.

[22]. H. Hirasawa, Precipitation process of Al—Mn and Al—Cr supersaturated solid solution in presence of age hardening phases, Scripta Metallurgica 9(9) (1975) 955-958.

[23]. T. Homma, M. P. Moody, D. W. Saxey, S. P. Ringer, Effect of Sn Addition in Preprecipitation Stage in Al—Cu Alloys: A Correlative Transmission Electron Microscopy and Atom Probe Tomography Study, Metallurgical and Materials Transactions A 43(7) (2012) 2192-2202.

[24]. B. W. Krakauer, D. N. Seidman, Systematic procedures for atom-probe field-ion microscopy studies of grain boundary segregation, Rev. Sci. Instrum. 63(9) (1992) 4071-4079.

[25]. D. N. Seidman, Three-Dimensional Atom-Probe Tomography: Advances and Applications, Annual Review of Materials Research 37(1) (2007) 127-158.

[26]. D. N. Seidman, B. W. Krakauer, D. Udler, Atomic scale studies of solute-atom segregation at grain boundaries: Experiments and simulations, J. Phys. Chem. Solids 55(10) (1994) 1035-1057.

[27]. D. N. Seidman, Subnanoscale Studies of Segregation at Grain Boundaries: Simulations and Experiments, Annual Review of Materials Research 32(1) (2002) 235-269.

[28]. D. N. Seidman, K. Stiller, An Atom-Probe Tomography Primer, MRS Bull. 34(10) (2009) 717-724.

[29]. D. Seidman, K. Stiller, A Renaissance in Atom-Probe Tomography, Materials Research Society Bulletin 34(10) (2009) 717.

[30]. B. Gault, M. P. Moody, F. d. Geuser, G. Tsafnat, A. L. Fontaine, L. T. Stephenson, D. Haley, S. P. Ringer, Advances in the calibration of atom probe tomographic reconstruction, J. Appl. Phys. 105(3) (2009) 034913.

[31]. B. Gault, M. P. Moody, J. M. Cairney, S. P. Ringer, Atom probe microscopy, Springer-Verlag New York 2012.

[32]. O. C. Hellman, J. A. Vandenbroucke, J. Rüsing, D. Isheim, D. N. Seidman, Analysis of three-dimensional atom-probe data by the proximity histogram, Microsc. Microanal. 6(5) (2000) 437-444.

[33]. C. K. Sudbrack, R. D. Noebe, D. N. Seidman, Direct observations of nucleation in a nondilute multicomponent alloy, Physical Review B 73(21) (2006) 212101.

[34]. T. Takeuchi, T. Onogi, E. Banno, U. Mizutani, Direct Evidence of the Hume-Rothery Stabilization Mechanism in Al—Mn—Fe—Si Mackay-Type 1/1-Cubic Approximants, MATERIALS TRANSACTIONS 42(6) (2001) 933-938.

[35]. K. Sugiyama, N. Kaji, K. Hiraga, Re-Refinement of [alpha]-(AlMnSi), Acta Crystallographica Section C 54(4) (1998) 445-447.

[36]. A. R. Farkoosh, D.C. Dunand, D. N. Seidman, Solute-induced strengthening during creep of an aged-hardened Al—Mn—Zr alloy, Prepared for Acta Materialia (2021).

[37]. H. J. Frost, M. F. Ashby, Deformation mechanism maps: the plasticity and creep of metals and ceramics, Pergamon press 1982.

[38]. M. E. Kassner, Fundamentals of Creep in Metals and Alloys (Third Edition), Butterworth-Heinemann, Boston, 2015.

[39]. F. R. N. Nabarro, F. De Villiers, Physics of creep and creep-resistant alloys, CRC press 1995.

[40]. M. E. Krug, D. N. Seidman, D. C. Dunand, Creep properties and precipitate evolution in Al—Li alloys microalloyed with Sc and Yb, Mater. Sci. Eng. A 550 (2012) 300-311.

[41]. N. Q. Vo, D. Bayansan, A. Sanaty-Zadeh, E. Ramos, D. C. Dunand, Effect of Yb microadditions on creep resistance of a dilute Al—Er—Sc—Zr alloy, Materialia (2018).

[42]. Y. H. Yeh, H. Nakashima, H. Kurishita, S. Goto, H. Yoshinaga, High-Temperature Creep and Threshold Stress of Precipitation-Hardened Al-0.7 at % Mn Alloy, Mater. Trans., JIM 32(1) (1991) 52-60.

[43]. E. Arzt, M. F. Ashby, Threshold stresses in materials containing dispersed particles, (1982).

[44]. E. Arzt, D. S. Wilkinson, Threshold stresses for dislocation climb over hard particles: The effect of an attractive interaction, Acta Metall. 34(10) (1986) 1893-1898.

[45]. Y. Li, T. G. Langdon, Creep behavior of an Al-6061 metal matrix composite reinforced with alumina particulates, Acta Mater. 45(11) (1997) 4797-4806.

[46]. R. A. Karnesky, PhD Thesis, Northwestern University, Mechanical properties and microstructure of aluminum-scandium with rare-earth element or aluminum oxide additions, 2007.

[47]. A. J. McAlister, D. J. Kahan, The Al—Sn (Aluminum-Tin) System, Bulletin of Alloy Phase Diagrams 4(4) (1983) 410-414.

[48]. T. Cheng, Y. Tang, L. Zhang, Update of thermodynamic descriptions of the binary Al—Sn and ternary Mg—Al—Sn systems, Calphad 64 (2019) 354-363.

[49]. G. ErdÉlyi, K. Freitag, H. Mehrer, Diffusion of tin implanted in aluminium, Philos. Mag. A 63(6) (1991) 1167-1174.

[50]. Q. S. Mei, K. Lu, Melting and superheating of crystalline solids: From bulk to nanocrystals, Prog. Mater Sci. 52(8) (2007) 1175-1262.

[51]. L. E. Samuels, The solid solubility of tin, indium and cadmium in aluminum J. Inst.

Metals (1956) Pages: 333-6.

[52]. R. C. Dorward, The solubility of tin in aluminum, Metall. Trans. A 7(2) (1976) 308-310.

[53]. C. S. Huskamp, et al., "Aluminum alloy with additions of scandium, zirconium and erbium", WO2013130274 A3, 2013.

[54]. N. Q. Vo, et al., "Aluminum superalloys for use in high temperature applications", CA2941734C, 2017.

[55]. N. Q. Vo, et al., "High-performance 3000-series aluminum alloys" US2019/0390312 A1, 2019.

[56]. N. Q. Vo, et al., "Ribbons and powders from high strength Corrosion resistant aluminum alloys", WO2018/009359 A1, 2018.

[57]. B. Lenczowski, "Scandum-containing aluminum alloy for powder Metallurgical technologies", US2017/0165795 A1, 2017.

[58]. S. Kirkham et al., "Multilayer aluminum brazing sheet material", CN106573346B, 2019.

What is claimed is:

1. An aluminum alloy, comprising:

aluminum (Al), manganese (Mn), silicon (Si), a first composition comprising one or more of tin (Sn), indium (In), antimony (Sb) and bismuth (Bi), and a second composition comprising titanium (Ti) and/or vanadium (V), and an impurity-level concentration of iron (Fe) that is about 0.004-0.01 at. % of said aluminum alloy, wherein aluminum alloy is formed by providing a first molten mass of aluminum held at a first temperature;

adding one or more of tin, antimony, indium, bismuth, and a series of master alloys sequentially to the first molten mass with a holding time between each addition to produce a second molten mass, wherein the series of master alloys comprises Al-10Mn and Al-12Si (at. %), and wherein the Al-10Mn master alloy is preheated at a second temperature; and maintaining the second molten mass at the first temperature for a period of time, periodically stirring and then casting the second molten mass into a mold to form an ingot, wherein the mold is preheated at a third temperature, and placed on an ice-cooled copper platen immediately prior to casting, to enhance directional solidification.

2. The aluminum alloy of claim 1, wherein said manganese comprises about 0.3-0.7 at. % of said aluminum alloy;

said silicon comprises about 0.2-1.0 at. % of said aluminum alloy; and said first composition comprises about 0.01-0.02 at. % of said aluminum alloy.

3. The aluminum alloy of claim 1, wherein said second composition further comprises at least one of gallium (Ga), copper (Cu), chromium (Cr), zirconium (Zr) and zinc (Zn).

4. The aluminum alloy of claim 3, wherein said gallium comprises at most about 0.01 at. % of said aluminum alloy;

said copper comprises about 0.01-0.1 at. % of said aluminum alloy;

said titanium comprises about 0.01-0.11 at. % of said aluminum alloy;

said vanadium comprises about 0.01-0.05 at. % of said aluminum alloy;

said chromium comprises at most about 0.1 at. % of said aluminum alloy;

said zirconium comprises about 0.01-0.1 at. % of said aluminum alloy; and said zinc comprises about 0.01-0.3 at. % of said aluminum alloy.

5. The aluminum alloy of claim 3, being characterized by having a peak microhardness value of about 525±5 MPa upon isochronal aging to about 475° C., wherein the peak microhardness value is increasable by adjusting the Si and Zr concentrations.

6. The aluminum alloy of claim 1, having α-Al(Mn,Fe)Si precipitates distributed uniformly.

7. The aluminum alloy of claim 6, wherein the number densities of the α-Al(Mn,Fe)Si precipitates at the peak-aged state are greater than about $10^{22}$ $m^{-3}$.

8. The aluminum alloy of claim 6, wherein the mean radius of the α-Al(Mn,Fe)Si precipitates at the peak-aged state are less than about 25 nm.

9. The aluminum alloy of claim 1, having Al-X, (X=Sn, In, Sb, or Bi) nanoprecipitates with a mean radius of about 1.5 nm within an Al(f.c.c.) matrix.

* * * * *